US007413284B2

(12) United States Patent
Higginson et al.

(10) Patent No.: US 7,413,284 B2
(45) Date of Patent: Aug. 19, 2008

(54) MOUNTING ASSEMBLY

(75) Inventors: John A. Higginson, Santa Clara, CA (US); Andreas Bibl, Los Altos, CA (US); Kevin Von Essen, San Jose, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 279 days.

(21) Appl. No.: 11/117,146

(22) Filed: Apr. 27, 2005

(65) Prior Publication Data

US 2005/0243127 A1 Nov. 3, 2005

Related U.S. Application Data

(60) Provisional application No. 60/567,070, filed on Apr. 30, 2004, provisional application No. 60/567,035, filed on Apr. 30, 2004.

(51) Int. Cl.
*B41J 2/14* (2006.01)

(52) U.S. Cl. ..... 347/49; 347/42

(58) Field of Classification Search ..... 347/42, 347/49

See application file for complete search history.

(56) References Cited

U.S. PATENT DOCUMENTS 4,433,341 A 2/1984 Thomas
4,527,175 A 7/1985 Kojima et al.
4,529,445 A 7/1985 Buschow
4,661,458 A 4/1987 Berry et al.
4,680,696 A 7/1987 Eminuma et al.
4,825,227 A 4/1989 Fishbeck et al.
4,840,998 A 6/1989 Asakawa
4,929,963 A 5/1990 Balazar
4,937,598 A 6/1990 Hine
4,940,998 A 7/1990 Asakawa
5,265,315 A 11/1993 Hoisington et al.

(Continued)

FOREIGN PATENT DOCUMENTS

CN 1984780 A 6/2007

(Continued)

OTHER PUBLICATIONS

U.S. Appl. No. 10/189,947, filed Jul. 3, 2002 Bibl et al.

(Continued)

*Primary Examiner*—Matthew Luu
*Assistant Examiner*—Justin Seo
(74) *Attorney, Agent, or Firm*—Fish & Richardson P.C.

(57) ABSTRACT

A mounting assembly is described for mounting and housing printhead modules. The mounting assembly includes a lower plate, an upper plate and multiple mounting blocks. The lower plate can include openings configured to expose a surface of a printhead module housed within the mounting assembly, the surface including multiple ink nozzle openings. Each opening can include alignment datums to align the printhead module in a first direction and in a second direction. The upper plate is approximately parallel to the lower plate, and can include multiple openings configured to provide access to ink channels formed in printhead modules housed within the mounting assembly. The mounting blocks are positioned between and affixed to the lower and upper plates, and are configured to couple to a printhead module. Each mounting block can include a datum to align the printhead module in a third direction.

20 Claims, 19 Drawing Sheets

U.S. PATENT DOCUMENTS

| | | | | |
|---|---|---|---|---|
| 5,365,843 | A | 11/1994 | House et al. | |
| 5,461,405 | A | 10/1995 | Lehmann et al. | |
| 5,489,930 | A | 2/1996 | Anderson | |
| 5,546,109 | A | 8/1996 | Nakano | |
| 5,610,645 | A | 3/1997 | Moore et al. | |
| 5,646,658 | A | 7/1997 | Thiel et al. | |
| 5,724,082 | A | 3/1998 | Moynihan | |
| 5,751,300 | A | 5/1998 | Cowger et al. | |
| 5,782,184 | A * | 7/1998 | Albertalli et al. | 101/486 |
| 5,831,654 | A | 11/1998 | Colombat et al. | |
| 5,885,455 | A | 3/1999 | Graus et al. | |
| 5,936,650 | A | 8/1999 | Ouchida et al. | |
| 6,000,792 | A | 12/1999 | Koizumi et al. | |
| 6,068,367 | A | 5/2000 | Fabbri et al. | |
| 6,084,618 | A | 7/2000 | Baker et al. | |
| 6,152,559 | A | 11/2000 | Kojima et al. | |
| 6,217,164 | B1 | 4/2001 | Hino | |
| 6,391,193 | B1 | 5/2002 | Luka | |
| 6,406,137 | B1 | 6/2002 | Okazaki et al. | |
| 6,428,141 | B1 * | 8/2002 | McElfresh et al. | 347/40 |
| 6,457,811 | B1 | 10/2002 | Pan et al. | |
| 6,467,874 | B1 * | 10/2002 | Williams et al. | 347/42 |
| 6,499,823 | B2 | 12/2002 | Okazaki et al. | |
| 6,554,398 | B2 | 4/2003 | Wyngaert et al. | |
| 6,634,742 | B2 | 10/2003 | Owaki et al. | |
| 6,652,083 | B2 | 11/2003 | Ison et al. | |
| 6,655,786 | B1 | 12/2003 | Foote et al. | |
| 6,672,706 | B2 | 1/2004 | Silverbrook | |
| 6,672,707 | B2 | 1/2004 | Silverbrook | |
| 6,685,299 | B2 | 2/2004 | Hirota | |
| 6,715,863 | B2 | 4/2004 | Shimizu | |
| 6,752,493 | B2 | 6/2004 | Dowell et al. | |
| 6,796,630 | B2 * | 9/2004 | Ison et al. | 347/18 |
| 6,869,167 | B2 * | 3/2005 | Silverbrook | 347/49 |
| 2002/0024554 | A1 | 2/2002 | Tominaga | |
| 2002/0180835 | A1 | 12/2002 | Boyd et al. | |
| 2003/0227516 | A1 * | 12/2003 | Yamaguchi et al. | 347/49 |
| 2003/0234845 | A1 | 12/2003 | Tominaga et al. | |
| 2004/0021735 | A1 | 2/2004 | Horii et al. | |
| 2005/0243127 | A1 | 11/2005 | Higginson et al. | |
| 2005/0270329 | A1 | 12/2005 | Hoisington et al. | |
| 2005/0280678 | A1 | 12/2005 | Bibl et al. | |
| 2006/0250493 | A1 | 11/2006 | Silverbrook et al. | |

FOREIGN PATENT DOCUMENTS

| | | | |
|---|---|---|---|
| CN | 1997521 | A | 7/2007 |
| EP | 0 383 558 | | 8/1990 |
| EP | 0666177 | | 8/1995 |
| EP | 1186416 | | 3/2002 |
| EP | 1238813 | | 9/2002 |
| EP | 1258354 | A2 | 11/2002 |
| EP | 1 336 486 | | 8/2003 |
| EP | 1748895 | | 2/2007 |
| EP | 1748897 | | 2/2007 |
| JP | 07017050 | | 1/1995 |
| JP | 2003127385 | | 5/2003 |
| JP | 2007535431 | | 12/2007 |
| JP | 2007535433 | | 12/2007 |
| WO | 2005108094 | | 11/2005 |
| WO | 2005108097 | A | 11/2005 |

OTHER PUBLICATIONS

U.S. Appl. No. 10/836,456, filed Apr. 30, 2004 von Essen.
U.S. Appl. No. 60/510,459, filed Oct. 10, 2003 Chen et al.
U.S. Appl. No. 60/566,729, filed Apr. 30, 2004 von Essen et al.
U.S. Appl. No. 60/567,035, filed Apr. 30, 2004 von Essen et al.
U.S. Appl. No. 60/,567,070, filed Apr. 30, 2004 Higginson et al.

* cited by examiner

MOUNTING ASSEMBLY

CROSS REFERENCE TO RELATED APPLICATION

This application claims priority to now abandoned U.S. Provisional Application Ser. No. 60/567,070, entitled "Mounting Assembly", filed on Apr. 30, 2004, the entire contents of which are hereby incorporated by reference, and claims priority to now abandoned U.S. Provisional Application Ser. No. 60/567,035, entitled "Recirculation Assembly", filed on Apr. 30, 2004, the entire contents of which are hereby incorporated by reference.

BACKGROUND

The following description relates to a mounting assembly.

An ink jet printer typically includes an ink path from an ink supply to an ink nozzle assembly that includes nozzle openings from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzle openings with a corresponding array of ink paths and associated actuators, and drop ejection from each nozzle opening can be independently controlled. In a so-called "drop-on-demand" printhead, each actuator is fired to selectively eject a drop at a specific pixel location of an image, as the printhead and a printing media are moved relative to one another. In high performance printheads, the nozzle openings typically have a diameter of 50 microns or less (e.g., 25 microns), are separated at a pitch of 100-300 nozzles per inch and provide drop sizes of approximately 1 to 70 picoliters (Pl) or less. Drop ejection frequency is typically 10 kHz or more.

A printhead can include a semiconductor printhead body and a piezoelectric actuator, for example, the printhead described in Hoisington et al., U.S. Pat. No. 5,265,315. The printhead body can be made of silicon, which is etched to define ink chambers. Nozzle openings can be defined by a separate nozzle plate that is attached to the silicon body. The piezoelectroic actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the uniformity in size and velocity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the uniformity of the pressure pulse generated by the actuators. Contamination or debris in the ink flow can be reduced with the use of one or more filters in the ink flow path.

In some applications, the ink is recirculated from the ink source to the printhead and back to the ink source, for example, to prevent coagulation of the ink and/or to maintain the ink at a certain temperature above the ambient temperature, for example, by using a heated ink source.

SUMMARY

In general, in one aspect, the invention features a mounting assembly for mounting and housing a plurality of printhead modules. The mounting assembly includes a lower plate, an upper plate and a plurality of mounting blocks positioned and affixed to the lower and upper plates. The lower plate includes a plurality of openings. Each opening is configured to expose a surface of a printhead module housed within the mounting assembly and each opening includes at least one alignment datum to align the printhead module in a first direction and at least one alignment datum to align the printhead module in a second direction, the surface of the printhead module including a plurality of ink nozzle openings. The upper plate is approximately parallel to the lower plate, the upper plate including a plurality of openings configured to provide access to ink channels formed in printhead modules housed within the mounting assembly. The plurality of mounting blocks are positioned between and affixed to the lower and upper plates. Each mounting block is configured to couple to a printhead module and including a datum to align the printhead module in a third direction.

Implementations of the invention can include one or more of the following features. The lower and upper plates can be formed from materials with low coefficients of thermal expansion, e.g., Invar.

The mounting assembly can further include a plurality of printhead modules housed within the mounting assembly and affixed to the plurality of mounting blocks, each printhead module including a plurality of ink nozzle openings configured to eject ink drops onto a printing media. The plurality of ink nozzle openings are arranged to provide a substantially uniform spacing between ink drops. The plurality of printhead modules are aligned in the first, second and third directions such that the substantially uniform spacing between ink drops is maintained between ink drops ejected from outermost ink nozzle openings of adjacent printhead modules.

Each alignment datum can include a protruding region of an inner surface of the opening, the protruding region extending inwardly toward the opening relative to a remainder of the inner surface. There can be two alignment datums in the first direction of each opening, the two alignment datums of an opening being in a same plane. The alignment datums in the first direction of openings that are adjacent in the second direction can be formed such that the alignment datums in the first direction are in a same plane. The at least one alignment datum in the second direction of each opening can be formed such that the alignment datums in the second direction of adjacent openings are in a same plane. The at least one alignment datum in the second direction of each opening can be formed such that the alignment datums in the second direction of adjacent openings are in different planes that are substantially parallel to one another and spaced a predetermined distance from one another. The alignment datums in the third direction formed on the mounting blocks can be formed such that the alignment datums are in a same plane.

In general, in another aspect, the invention features a method of mounting printhead modules in a mounting assembly. The method includes positioning a plurality of printhead modules in a plurality of openings formed in a lower plate of a mounting assembly, the mounting assembly including substantially parallel upper and lower plates separated by a plurality of mounting blocks. Each printhead module is aligned with at least one alignment datum formed in a first inner surface of the opening to align the printhead module in a first direction. Each printhead module is further aligned with at least one alignment datum formed in a second inner surface of the opening to align the printhead module in a second direction. Each printhead module is mounted onto a receiving surface of at least two mounting blocks, the receiving surface of each mounting block providing an alignment datum in a third direction.

Implementations of the invention can include one or more of the following features. Each of the plurality of printhead modules can include a plurality of ink nozzle openings in a lower surface of the printhead module, and the lower surface is exposed by the opening formed in the lower plate of the mounting assembly. The plurality of ink nozzle openings are configured to eject ink drops onto a printing media and are arranged to provide a substantially uniform spacing between ink drops. The method further can further include aligning the plurality of printhead modules relative to one another in the first, second and third directions such that the substantially uniform spacing between ink drops is maintained between ink drops ejected from outermost ink nozzle openings of adjacent printhead modules.

The method can further include forming at least one protruding region in the first inner surface of the opening, the protruding region comprising the at least one alignment datum in the first direction, and forming at least one protruding region in the second inner surface of the opening, the protruding region comprising the at least one alignment datum in the second direction. There can be two alignment datums in the first direction, and the method can further include forming the at least two alignment datums in the first direction of each opening such that the at least two alignment datums of an opening are in a same plane. The method can further include forming the alignment datums in the first direction of openings that are adjacent in the second direction such that the alignment datums in the first direction are in a same plane. The method can further include forming the at least one alignment datum in the second direction of each opening such that the at least one alignment datums of adjacent openings are in a same plane. The method can further include forming the at least one alignment datum in the second direction of each opening such that the at least one alignment datums of adjacent openings are in different planes that are substantially parallel to one another and spaced a predetermined distance from one another. The method can further include forming all of the alignment datums in the third direction in substantially a same plane.

In general, in another aspect, the invention features a system for housing printhead modules. The system includes a mounting assembly, a recirculation assembly and a plurality of printhead modules.

The mounting assembly includes a lower plate, an upper plate an a plurality of mounting blocks positioned between and affixed to the lower and upper plates. The lower plate includes a plurality of openings, where each opening is configured to expose a surface of a printhead module housed within the mounting assembly. Each opening includes at least two alignment datums to align the printhead module in a first direction and at least one alignment datum to align the printhead module in a second direction, the surface of the printhead module including a plurality of ink nozzle openings. The upper plate is approximately parallel to the lower plate and includes a plurality of openings configured to provide access to ink channels formed in printhead modules housed within the mounting assembly. Each of the plurality of mounting blocks is configured to couple to a printhead module and including a datum to align the printhead module in a third direction.

The recirculation assembly is attached to the upper plate of the mounting assembly, and includes a main ink inlet, a main ink outlet, and a channel. The main ink inlet is configured to receive ink from an ink source. The main ink outlet is configured to direct ink toward an ink source. The channel extends between the main ink inlet and the main ink outlet and includes an inlet portion and an outlet portion. The inlet portion is configured to move ink from the main ink inlet to a plurality of ink channels in fluid communication with a plurality of ink inlets for each of a plurality of printhead modules. The outlet portion is configured to move ink away from a plurality of ink channels in fluid communication with a plurality of ink outlets for each of the plurality of printhead modules and toward the main ink outlet.

Each of the plurality of printhead modules includes a plurality of ink nozzle openings configured to eject ink drops onto a printing media, at least one ink inlet in fluid communication with an ink channel formed in the recirculation assembly, and at least one ink outlet in fluid communication with an ink channel formed in the recirculation assembly.

Implementations of the invention can include one or more of the following features. The system can further include a compressible seal positioned between each ink inlet channel of a printhead module and a corresponding ink channel of the recirculation assembly, and positioned between each ink outlet channel of a printhead module and a corresponding ink channel of the recirculation assembly, such that the upper and lower plates of the mounting assembly can move relative to each other and maintain a seal between the ink inlet and outlet channels of the printhead modules and corresponding ink channels of the recirculation assembly.

The invention can be implemented to realize one or more of the following advantages. Ink nozzles formed in an exposed surface of printhead modules positioned adjacent to one another within a mounting assembly can be precisely aligned with one another in at least three directions (e.g., x, y and z directions), to maintain consistent pitch between ink drops ejected from different printhead modules. The configuration of the mounting assembly eases assembly and manufacture because the printhead modules can be mounted to mounting blocks and not directly secured to the upper plate: the upper and lower plates can therefore move relative to one another in the z direction. This is particularly important in larger mounting assemblies, which can require a thicker plate (higher section modulus), to reduce deflection and twist and to maintain flatness. Using upper and lower plates made of a low coefficient of thermal expansion material, e.g., Invar, provides a stiff and dimensionally accurate structure to the mounting assembly. The corner supports and/or mounting blocks provide additional support to the structure and optionally provide z alignment datums.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

Figure 6:
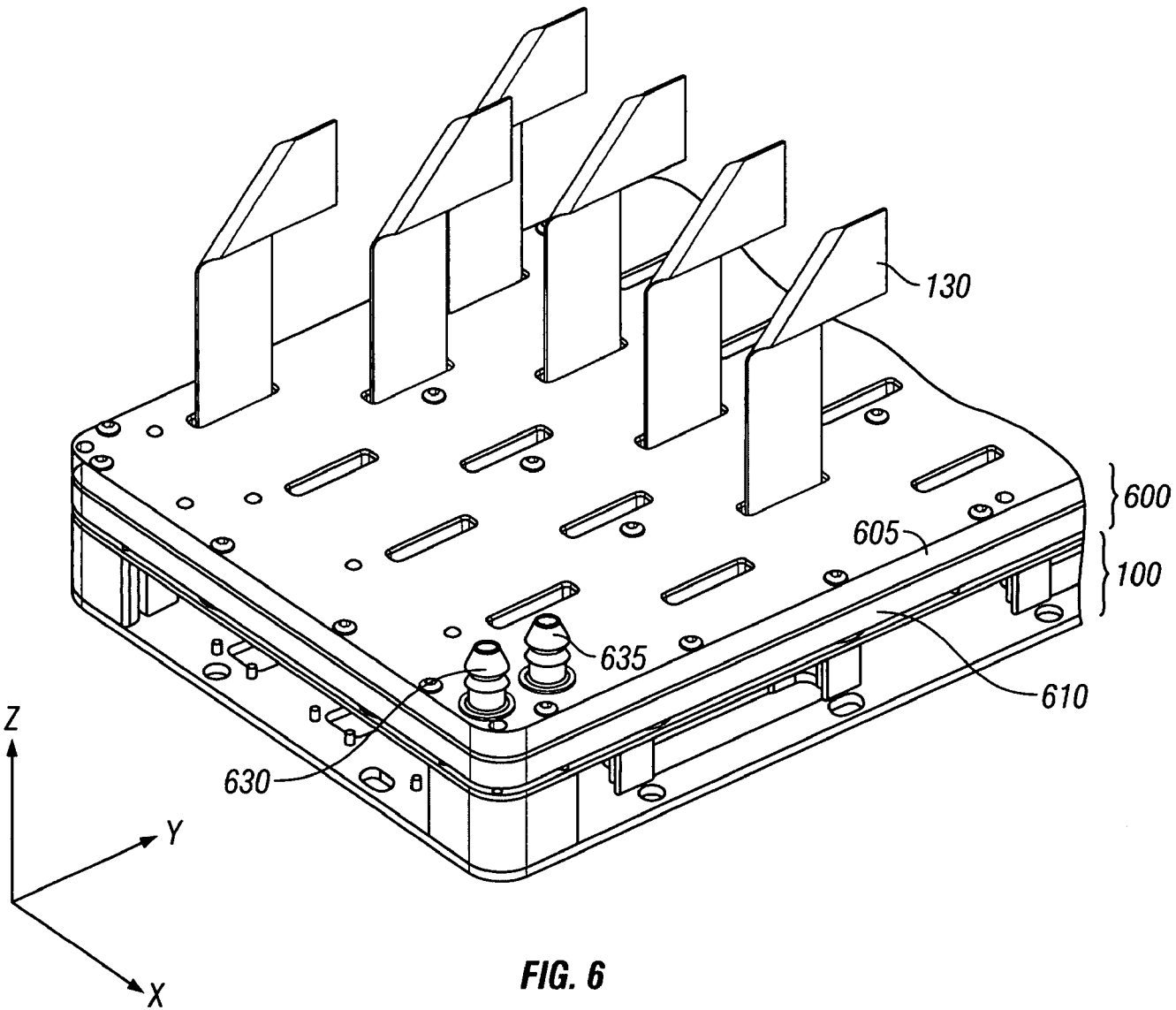
FIG. 6 shows a recirculation assembly mounted on a mounting assembly.

FIGS. 7A-D show the recirculation assembly of FIG. 6.

Figure 8:
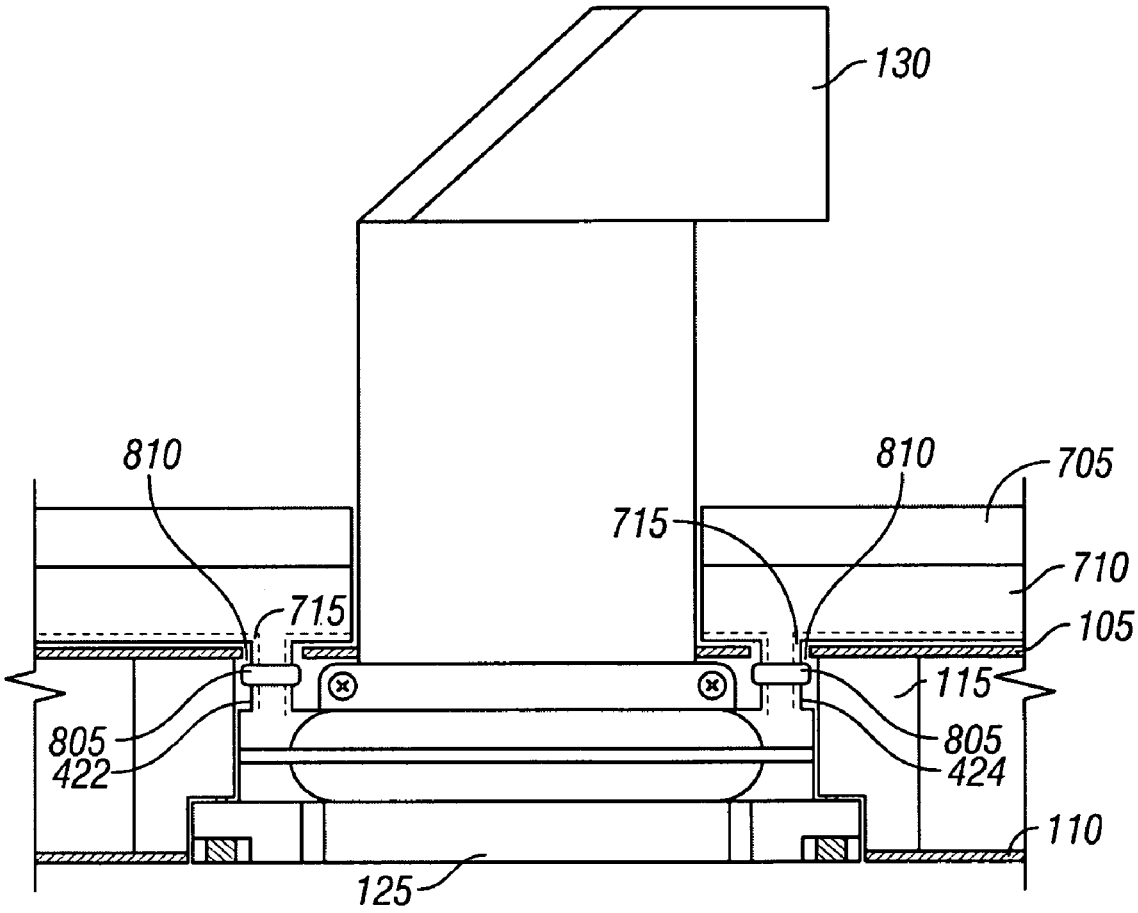

FIG. 8 shows a cross-sectional view of a portion of the recirculation assembly and mounting assembly of FIG. 6.

Figure 9:
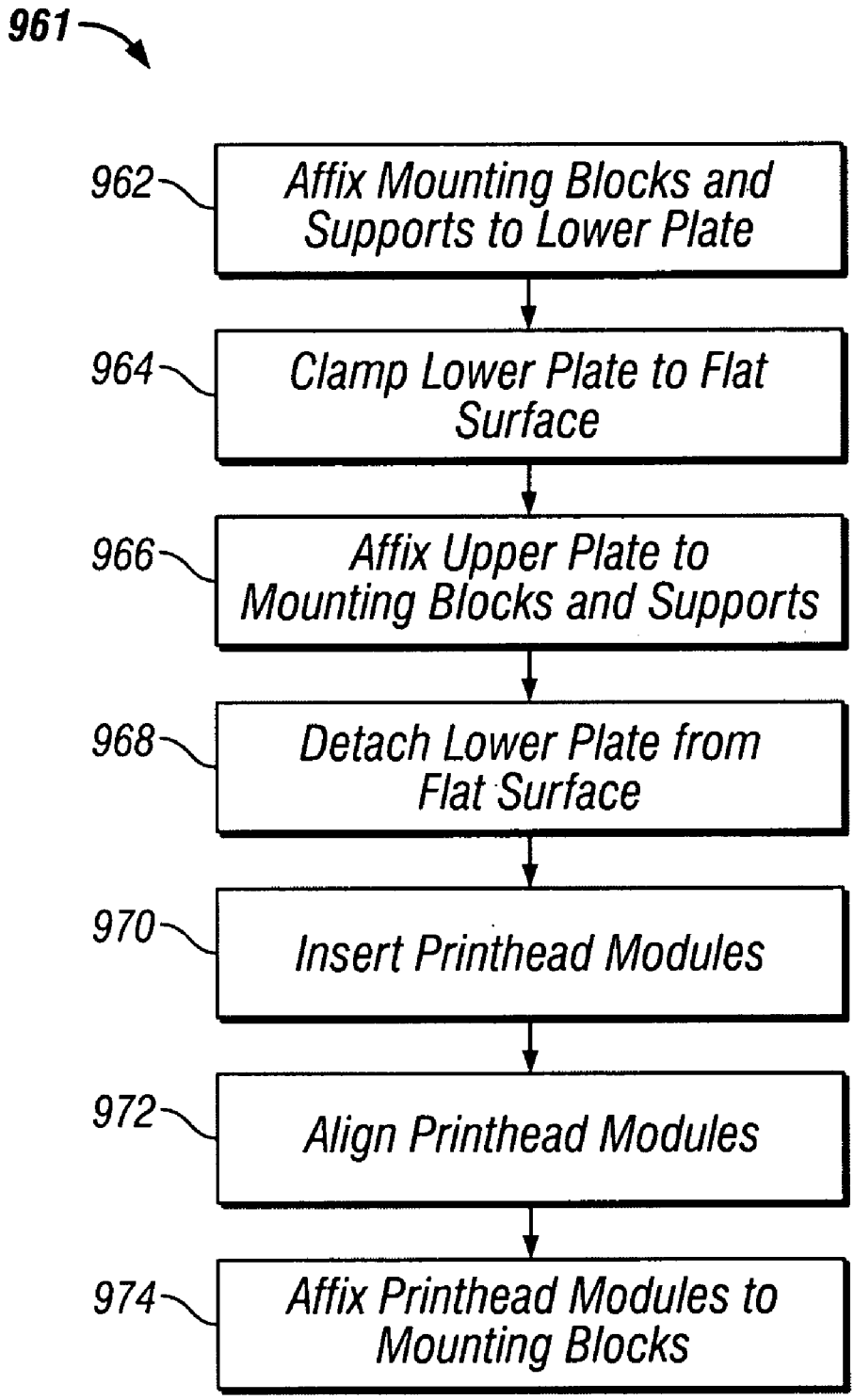

FIG. 9 is a flowchart showing a process for assembling a mounting assembly.

Figure 10A:
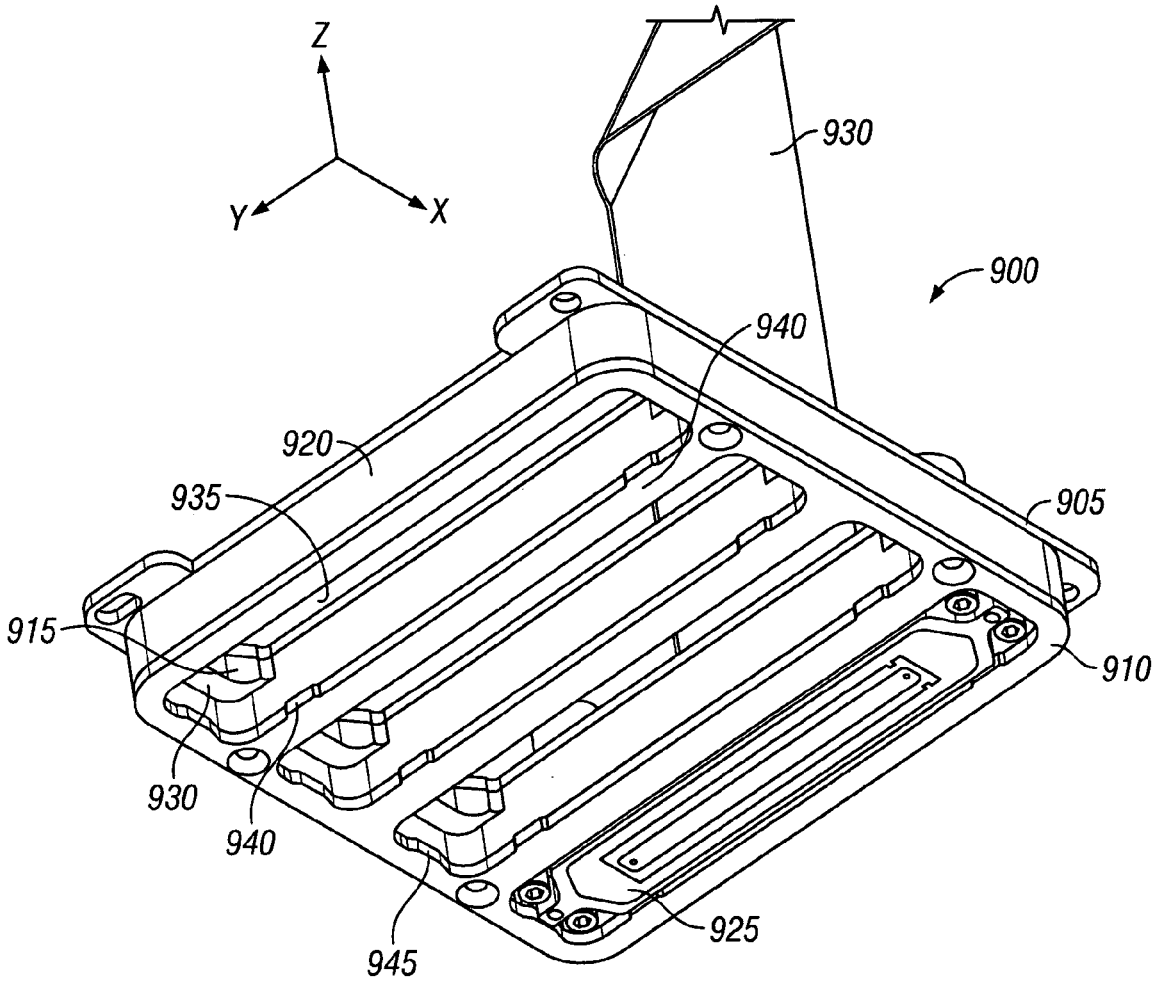
Figure 10B:
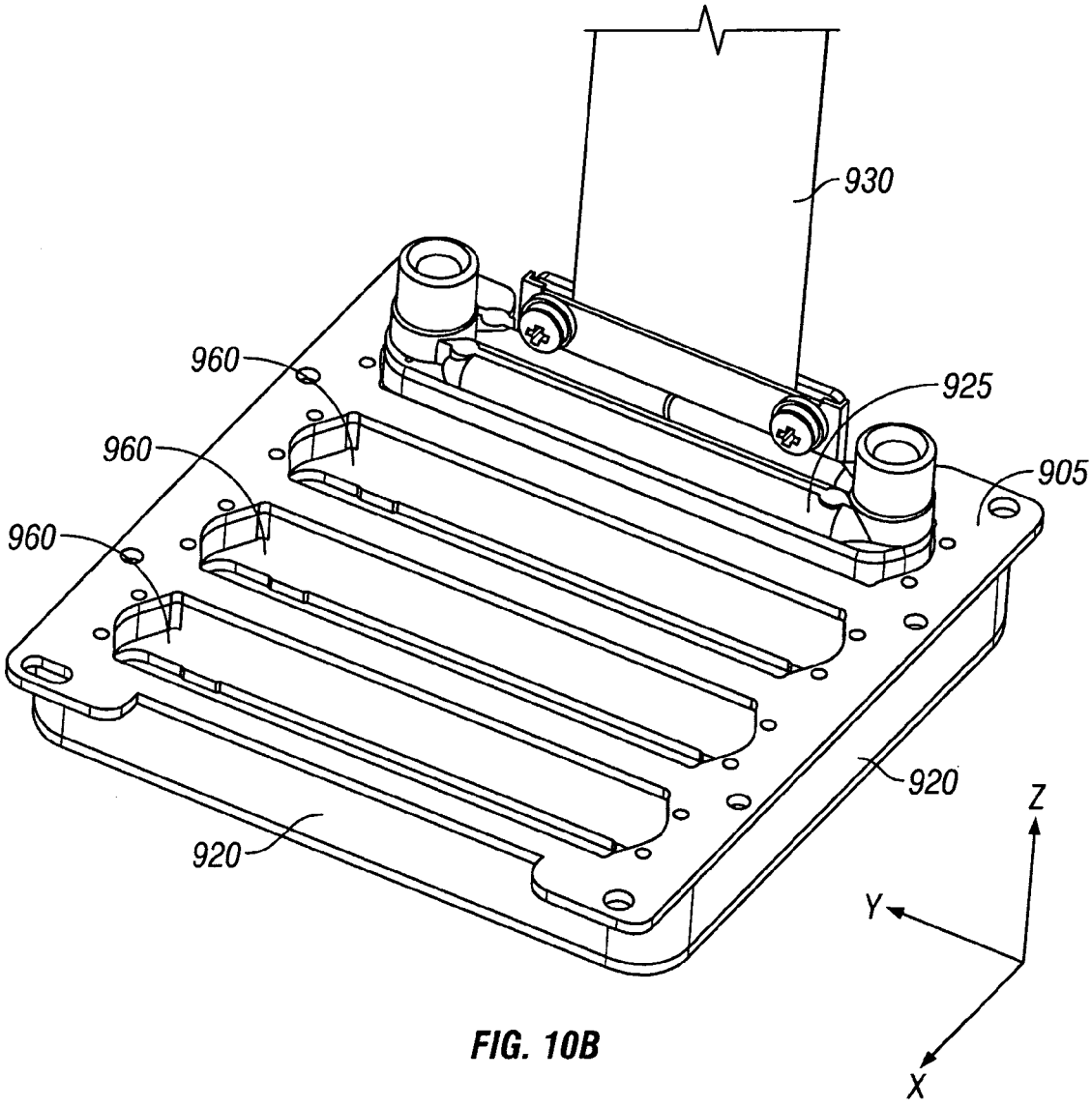
Figure 10C:
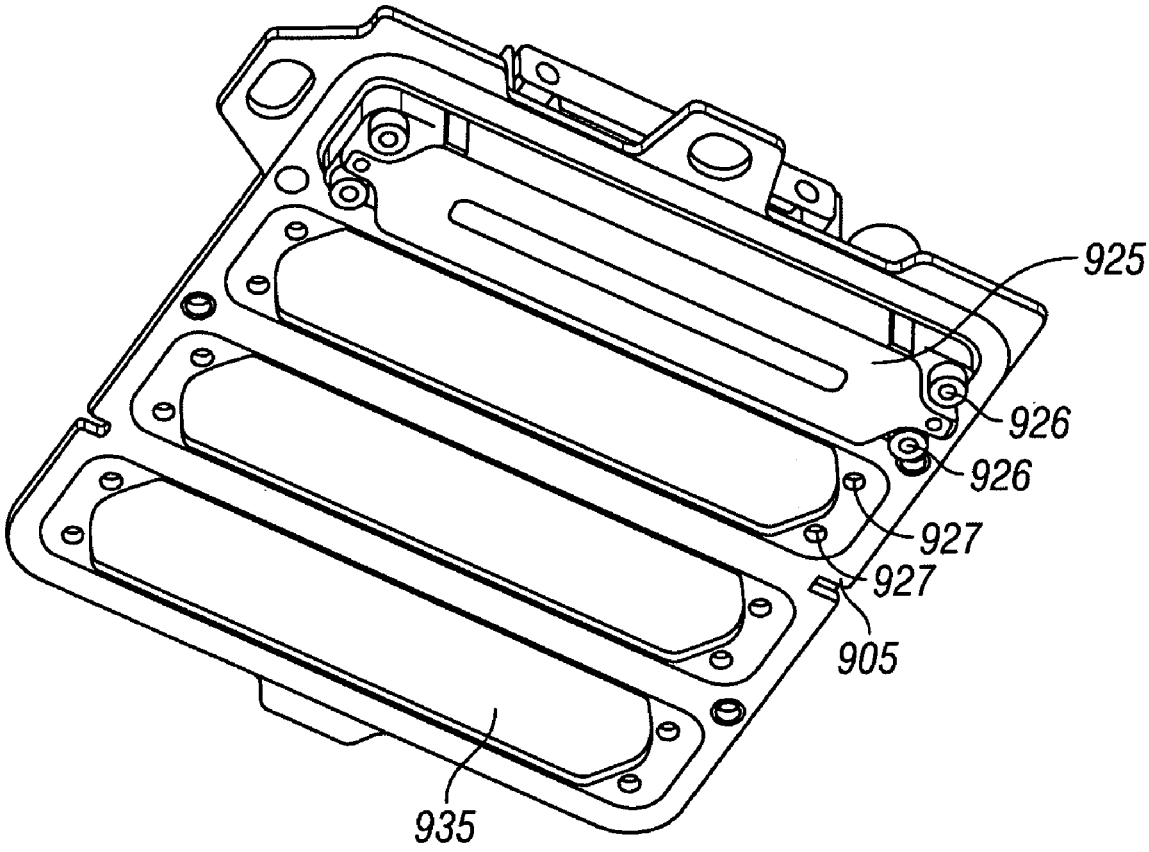

FIGS. 10A-C show a mounting assembly.

Like reference symbols in the various drawings indicate like elements.

DETAILED DESCRIPTION

Figure 1A:
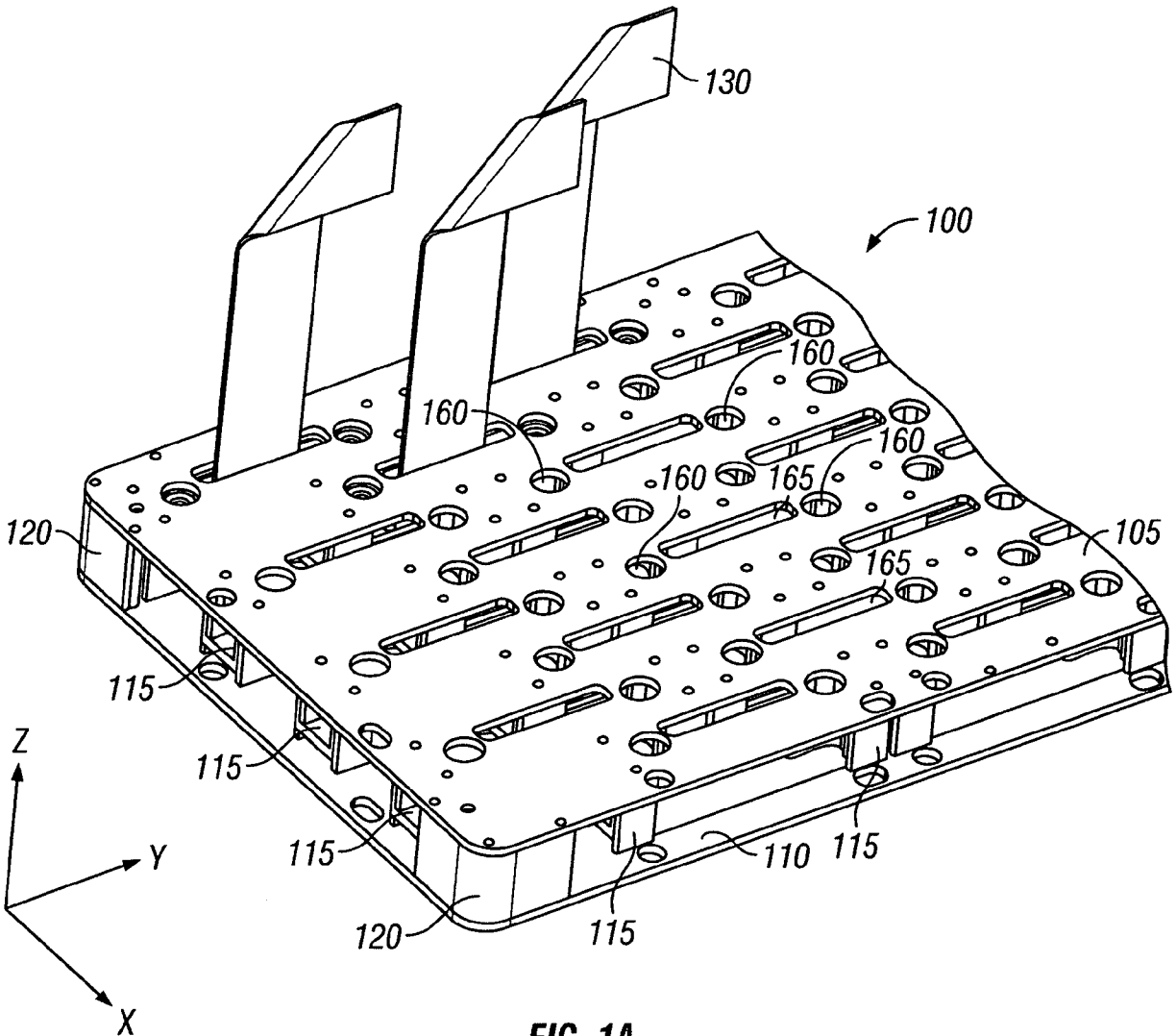
FIG. 1A shows a mounting assembly.

FIG. 1A shows a mounting assembly 100 for mounting and housing multiple printhead modules. Each printhead module can include a printhead unit, such as the semiconductor printhead unit described in U.S. Provisional Application, Ser. No. 60/510,459, entitled "Print Head with Thin Membrane", filed Oct. 10, 2003, the disclosure of which is hereby incorporated by reference. The printhead unit includes an ink nozzle unit for ejecting ink drops from nozzle openings onto a printing media moving relative to the printhead unit.

The mounting assembly 100 includes an upper plate 105 and a lower plate 110 separated by multiple mounting blocks 115 affixed to and positioned between the upper and lower plates 105, 110. FIG. 1 B shows the mounting assembly 100 with the upper plate 105 removed to expose the printhead modules 125 housed within the assembly 100.

Figure 1B:
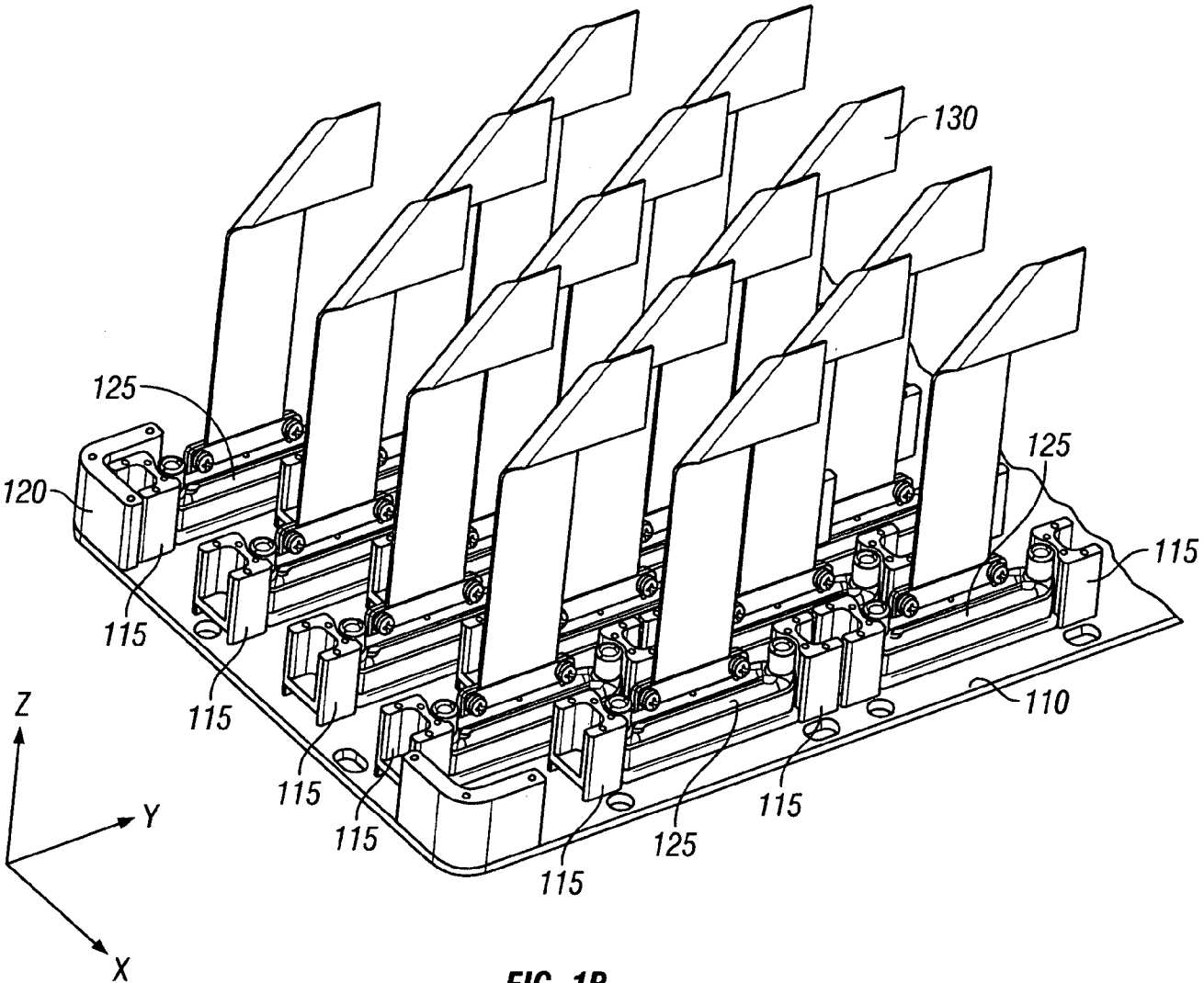
FIG. 1B shows the mounting assembly of FIG. 1A with an upper plate removed.
Figure 1C:
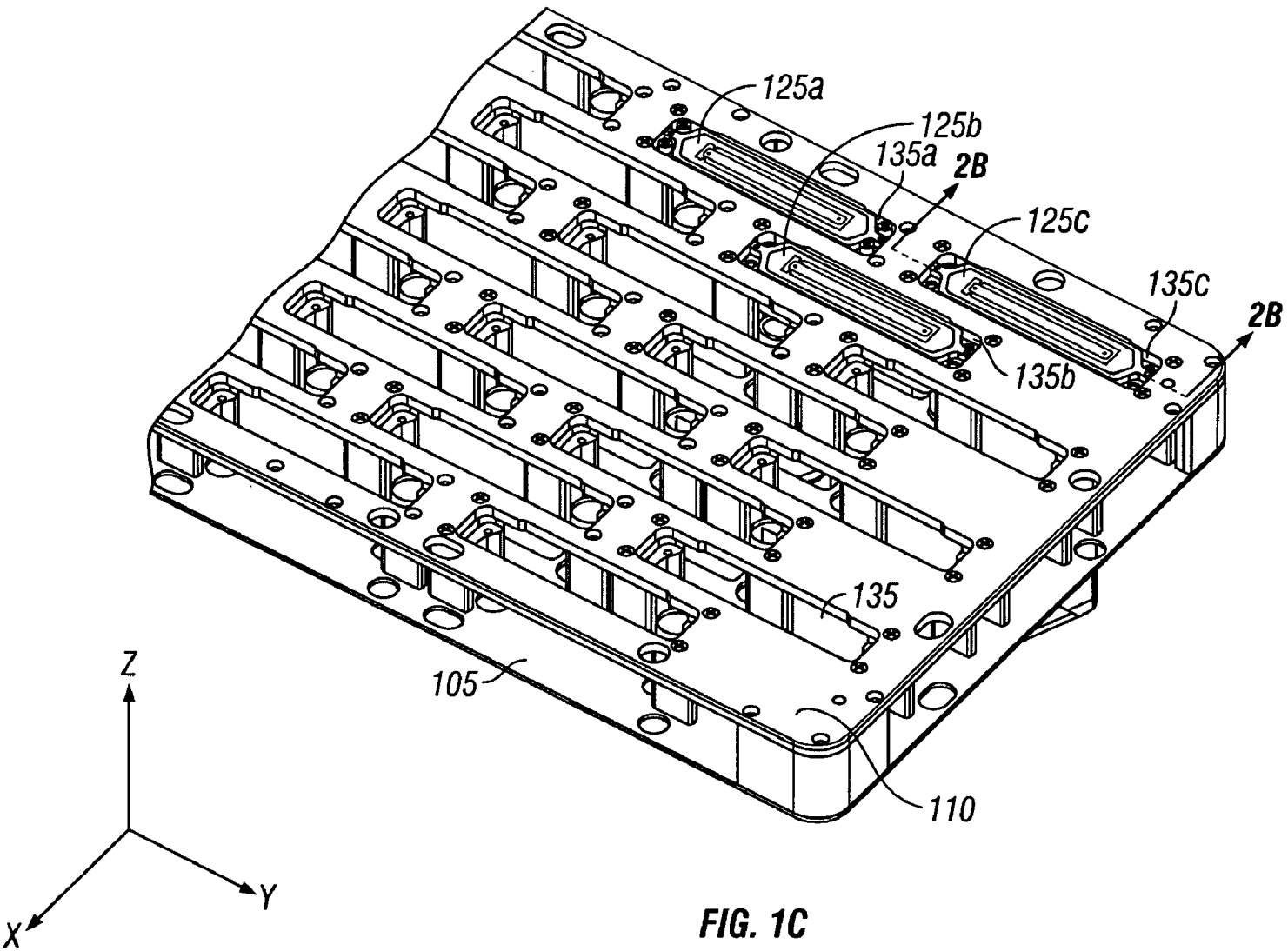
FIG. 1C shows an opposite view of the mounting assembly of FIG. 1A.

FIG. 1C is an opposite view of the mounting assembly 100 than is shown in FIG. 1A, and depicts the lower plate 110. Although the embodiment of the mounting assembly 100 shown in FIGS. 1A-C is capable of housing at least sixteen printhead modules, as is shown in FIG. 1B, for illustrative purposes in FIGS. 1A and 1C the mounting assembly 100 is shown housing four printhead modules 125, so that features of the mounting assembly 100 are not obscured by the presence of all sixteen printhead modules 125.

In FIG. 1B, flexible circuits 130 are shown extending from the multiple printhead modules, and in FIG. 1A, the circuits 130 are shown extending through apertures 165 in the upper plate 105 of the mounting assembly 100. A flexible circuit 130 can connect a processor housed in a printer to the piezoelectric actuators within the printhead modules, to control ejection of ink drops from the ink nozzles.

Referring to FIG. 1C, the lower plate 110 includes multiple openings 135. Each opening 135 is configured to receive a printhead module 125 and to expose the lower surface of the printhead module. The lower surface of a printhead module includes multiple ink nozzles configured to eject ink drops onto a printing media, the multiple ink nozzles arranged to provide a uniform spacing between the ink drops. In a mounting assembly configured to house multiple printhead modules, the alignment of the printhead modules relative to one another is critical to ensure that the uniform spacing between ink drops is maintained between ink drops ejected from adjacent printhead modules.

In one embodiment, as shown in FIG. 1C, there are at least four sets of four printhead modules and each set can eject ink drops of a different color, for example, cyan, magenta, yellow and black, such that a colored image can be printed using a combination of the four colors. Alternatively, the printhead modules can eject ink all of the same color to provide a higher resolution than if different ink colors were used in each set of printhead modules.

In either embodiment, precise uniform spacing of the ejected ink drops is critical, as even slight deviations from the uniform spacing can be detected by the human eye. Precise uniform spacing requires precise alignment of the printhead modules 125*a-c* in the x and y directions. Precise alignment in the z direction maintains the ink nozzles in each printhead module a uniform distance from a printing media. The location of an ink drop varies with, amongst other things, the distance from the ink nozzle to the printing media, and thereby aligning the ink nozzles in the z direction reduces the likelihood that ink drops ejected from each of the printhead modules 125*a-c* will be mislocated.

Figure 2A:
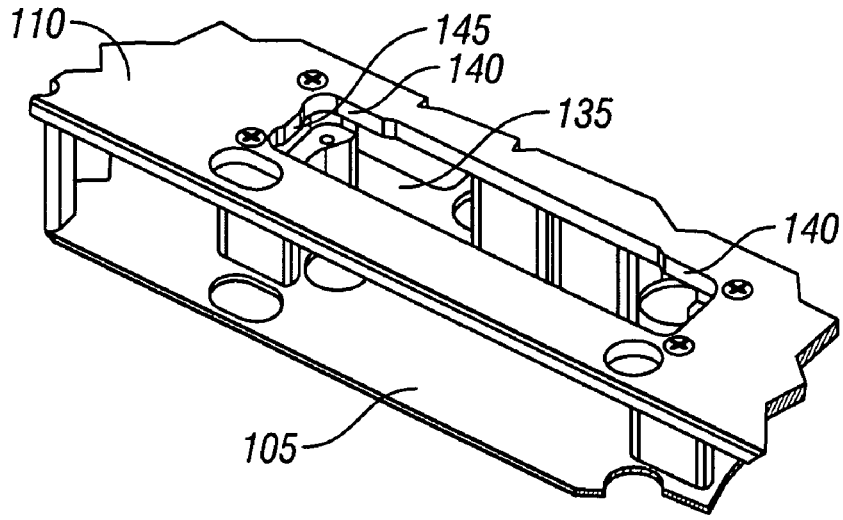
FIG. 2A shows an enlarged portion of the mounting assembly of FIG. 1C.

The printhead modules 125*a-c* are aligned in the x and y directions using datums formed in the lower plate 110 of the mounting assembly 100. FIG. 2A shows an enlarged portion of the mounting assembly 100 depicted in FIG. 1C. At least one x-alignment datum 140 to align a printhead module in the x direction is included along the lengthwise-inner surface of the opening 135, and a y-alignment datum 145 to align a printhead module in the y direction is included along the widthwise-inner surface of the opening 135. In one embodiment, as shown, a datum can be formed as a protruding region of the inner surface of the opening 135 that extends inwardly toward a printhead module relative to the remainder of the inner surface.

Figure 3A:
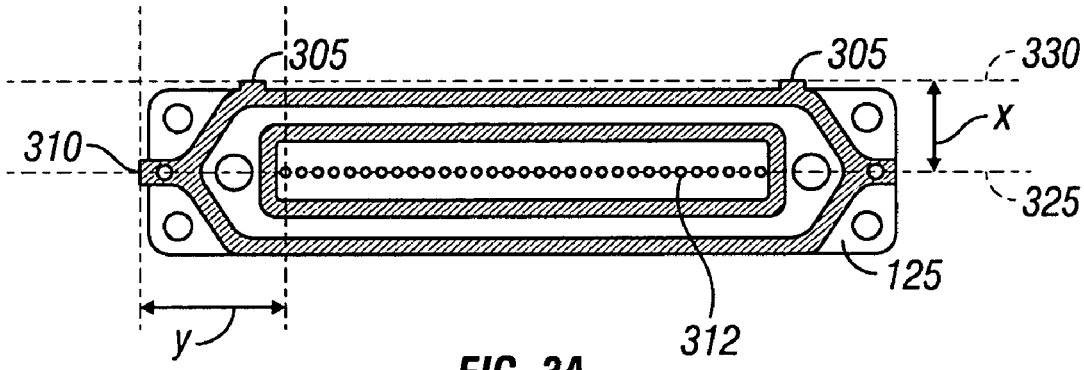
FIG. 3A shows a lower surface of a printhead housing.
Figure 3B:
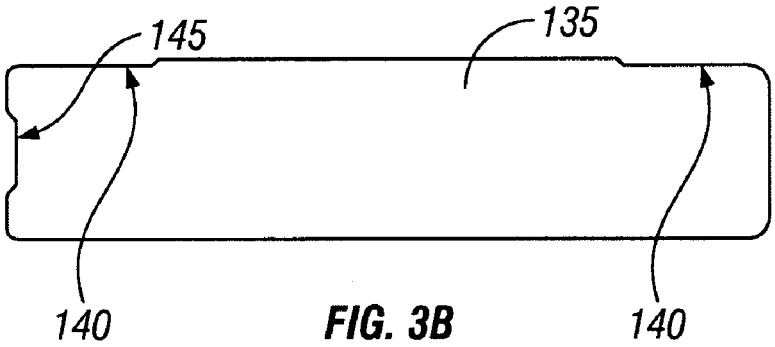
FIG. 3B shows an opening formed in a lower plate of a mounting assembly.
Figure 3C:
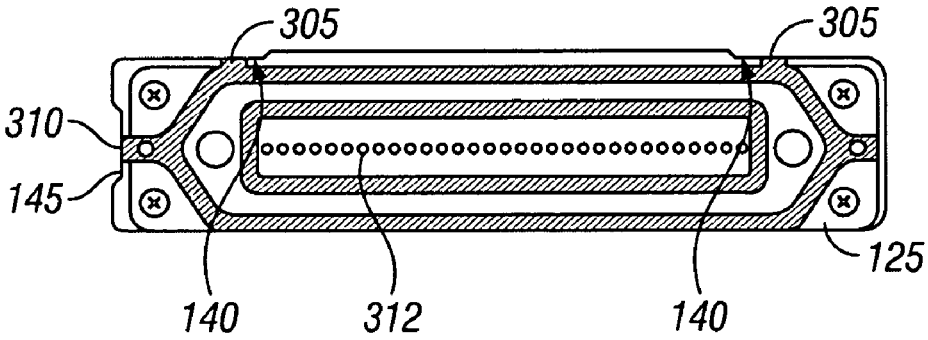
FIG. 3C shows the printhead housing of FIG. 3A housed in the opening shown in FIG. 3B.

Referring to FIGS. 3A-C, the x-alignment and y-alignment datums 140, 145 are configured to mate with alignment tabs 305, 310 formed on the outer surface of a printhead module 125 to be received within the opening 135. Referring to FIG. 3A, the x-alignment tabs 305 can be raised surfaces along a lengthwise-outer surface of the printhead module 135, and a y-alignment tab 310 can be a raised surface along a widthwise-outer surface of the printhead module 135. In the embodiment shown, two x-alignment tabs 305 and one y-alignment tab 310 are included on the printhead module 125, although more or fewer alignment tabs can be used, and the alignment tabs can be shaped differently (e.g., wider or higher) than the configuration depicted.

Referring to FIG. 3B, the x-alignment datums 140 and y-alignment datum 145 are shown as inverted regions on the inner surface of the opening 135. Referring to FIG. 3C, the printhead module 125 is positioned within the opening 135 such that the x-alignment tabs 305 mate with the x-alignment datums 140 formed in the inner surface of the opening 135.

The lower plate 110 of the mounting assembly, including the openings 135, is precision machined, such as by precision grinding or electrical discharge machining. The x-alignment 140 and y-alignment 145 datums can therefore be precisely positioned. More particularly, the x-alignment 140 and y-alignment 145 datums of adjacent openings 135 can be precisely positioned relative to one another.

Figure 3D:
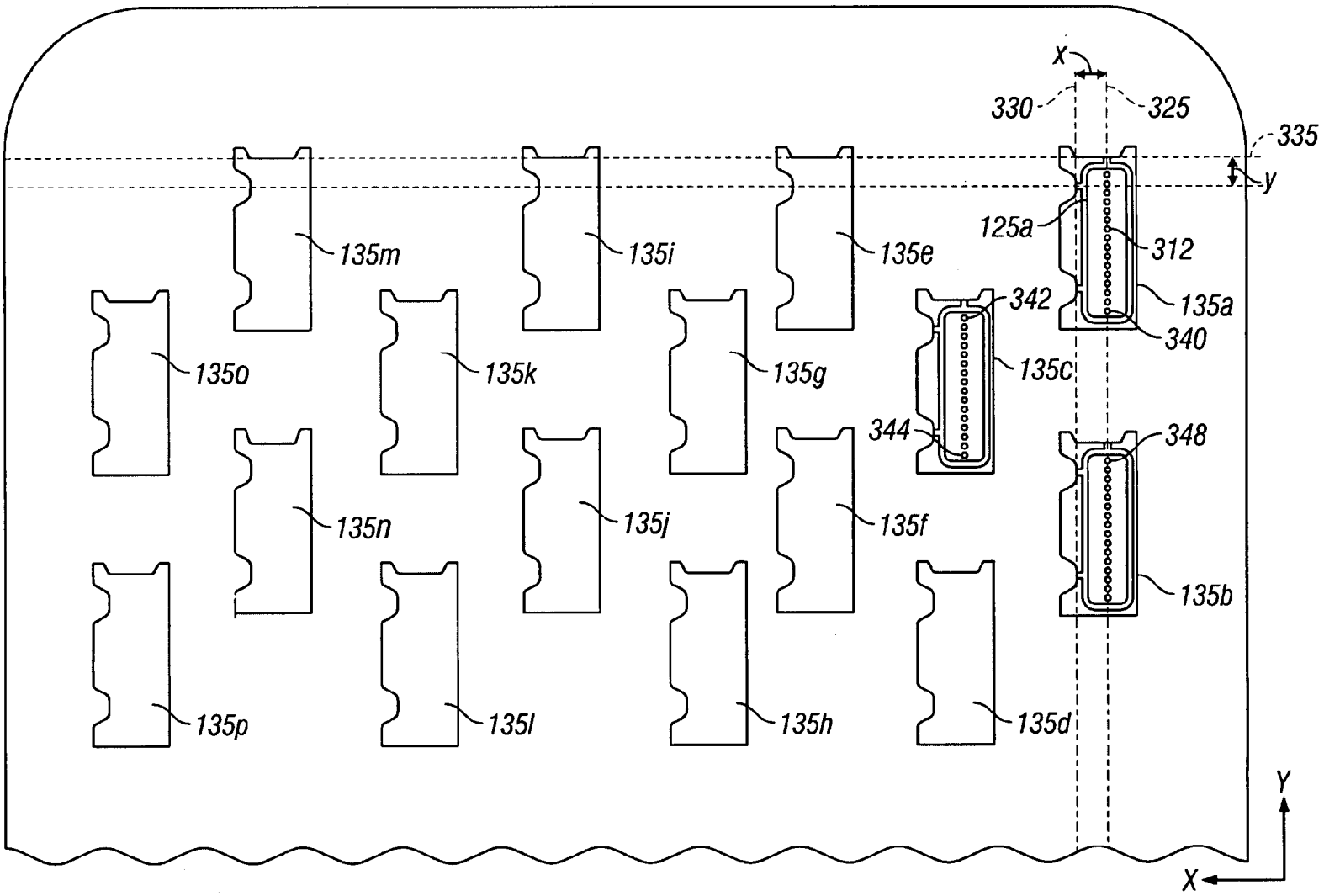
FIG. 3D shows a plan view of a lower plate of a mounting assembly.

Referring to openings 135*a-b* and printhead modules 125*a-b* shown in FIG. 3D, for illustrative purposes, the x-alignment datums 140 can be used to align nozzle openings of printhead modules in the x direction as follows. The x-alignment datums 140 are precision machined so that the datums 140 in the adjacent openings 135*a* and 135*b* are in the same plane 330. The printhead module 125*a* is positioned in the opening 135*a* with the x-alignment tabs 305 against the corresponding x-alignment datums 140.

The x-alignment tabs 305 of the printhead module 125*a* are precision machined before the printhead module 125*a* is positioned in the opening 135*a*. Referring to FIG. 3A, as an example, a manufacturer, such as a human operator (or alternatively an automated operator) examines the nozzles openings 312 (e.g., using a microscope) formed in the lower surface of an assembled printhead module 125*a*, and measures the distance from an axis 325 intersecting the nozzle openings to the plane 330 formed by the x-alignment tabs 305. The nozzle openings 312 are to be positioned a predetermined distance x from the plane 330 formed by the x-alignment tabs 305. If the nozzle openings 312 are not the distance x from the x-alignment tabs 305, then the operator adjusts the size of one or both of the x-alignment tabs 305. The operator adjusts the x-alignment tabs 305 until the axis 325 intersecting the nozzle openings 312 is precisely the distance x from the plane 330 formed by the x-alignment tabs 305. The x-alignment tabs 305 can be formed slightly larger than anticipated necessary to provide alignment in the x direction, such that the tabs 305 can be ground down or sawed off to the appropriate size to align the printhead module 125*a*. By contrast, if the x-alignment tabs 305 are too small, they cannot easily be adjusted to be larger, and the module 125*a* may be rendered useless for a particular implementation.

The y-alignment tab 310 is similarly precision machined by the operator, so that the nozzles openings of printhead module can be aligned in the y direction. For example, an operator can measure the distance from the outermost nozzle opening closest to the y-alignment tab 310 and the y-alignment tab 310 (e.g., using a microscope). If necessary, the y-alignment tab 310 is ground down or sawed off to adjust the distance from the outermost nozzle opening to the y-alignment tab 310, until the distance is precisely a predetermined distance y.

The printhead module 125*a*, with the precision machined x-alignment tabs 305 and y-alignment tab 310, is positioned in the opening 135*a* and secured to the mounting assembly 100. In the embodiment shown, the printhead module 125*a* is secured to the mounting assembly 100 by two screws that run through the printhead module 125*a* and secure to mounting blocks 115, described in further detail below. The printhead module 125*a* is secured to the mounting assembly 100 such that the x-alignment tabs 305 are pressed against the corresponding x-alignment datums 140, and the y-alignment tab 310 is pressed against the y-alignment datum 145.

The adjacent printhead modules 125*b* and 125*e* are similarly precision machined and positioned into the openings 135*b* and 135*e* respectively. That is, their respective x-alignment tabs 305 are adjusted so that the nozzle openings 312 are positioned a predetermined distance x from a plane formed by the x-alignment tabs 305. Their respective y-alignment tabs 310 are adjusted so that the distance from the outermost nozzle opening to the y-alignment tab 310 is precisely a predetermined distance y.

With respect to the x-direction, the nozzles openings 312 of printhead modules 125*a* and 125*b* are thereby aligned in the x direction, i.e., the axis 325 passes through the center of the nozzle openings 312 in both printhead modules 125*a* and 125*b* and is the distance x from the plane 330 formed by the x-alignment datums 140. With respect to the y-direction, the y-alignment datums 145 of openings 135*a* and 135*e* are in the same plane 335, and an outermost nozzle of each printhead module 125*a* and 125*e* is the same distance y from the corresponding y-alignment datums 145. Accordingly, the nozzles of the adjacent printhead modules 125*a* and 125*e* are aligned in the y direction.

In one implementation, the ink drops ejected from the printhead module 125*a* are desired to align with the ink drops ejected from the adjacent printhead module 125*e*, for example, if the color of ink ejected from each printhead module is different and the ink drops are intended to overlap to form different colors. Accordingly, the y-alignment datums 145 of the adjacent openings 135*a*, 135*e*, 135*i* and 135*m* within the same row are aligned in the same plane 335. The corresponding printhead modules 125*a*, 125*e*, 125*i* and 125*m* are positioned such that the outermost nozzle opening in each printhead module is precisely the distance y from the y-alignment datum 145, as described above. Accordingly, the ink nozzle openings 312 in each of the adjacent printhead modules within the same row are aligned in the y direction and ink drops ejected from the ink nozzles are also aligned.

The nozzle openings 312 of printhead modules adjacent in the y-direction must also be precisely positioned with respect to one another, so that the pitch between ink drops ejected from the nozzle openings is consistent in the y-direction. For example, consider the set of four printhead modules 125*a-d*. Multiple ink nozzle openings 312 are arranged along the length of the lower surface of each of the printhead modules, for example, each printhead module can include 60 uniformly spaced ink nozzles and thereby be capable of ejecting 60 uniformly spaced ink drops. The four printhead modules 125*a-d* are arranged in relation to each other such that between the four printhead modules, 240 uniformly spaced ink drops (i.e., 4 times 60) can be ejected in the y direction. An outermost ink nozzle 340 of printhead module 125*a* is spaced a precise distance from an outermost ink nozzle 342 in the adjacent printhead module 125*c*, so that ink drops ejected from the ink nozzles 340, 342 maintain the uniform spacing as between ink drops ejected from ink nozzles within the same printhead module, i.e. the pitch of the ink drops in the y direction is maintained between the adjacent printhead modules 125*a*, 125*c*. Similarly, the opposite outermost ink nozzle 344 in printhead module 125*c* is precisely spaced from an outermost ink nozzle 346 in the adjacent printhead module 125*b* to maintain a consistent pitch between ejected ink drops. Alternatively, the printhead modules 125*a* and 125*c* can be aligned in the y-direction to allow for some overlap between ink drops ejected from their corresponding ink nozzles, while maintaining a consistent pitch.

In another implementation, the ink drops ejected from adjacent printhead modules are desired to be offset from one another in the y-direction for higher print resolution, e.g., if the color of ink ejected from each printhead module is the same. For illustrative purposes, the adjacent openings 135*b*, 135*f*, 135*j* and 135*n* and corresponding printhead modules 125*b*, 125*f*, 125*j* and 125*n* shall be discussed. Ink drops ejected from the adjacent printhead modules can be offset from one another in the y-direction either by forming the y-alignment datums 145 in the corresponding openings offset from one another, or by adjusting the y-alignment tabs 310 of the printhead modules, such that the ink nozzle openings are positioned at different distances from corresponding y-alignment datums.

Figure 3E:
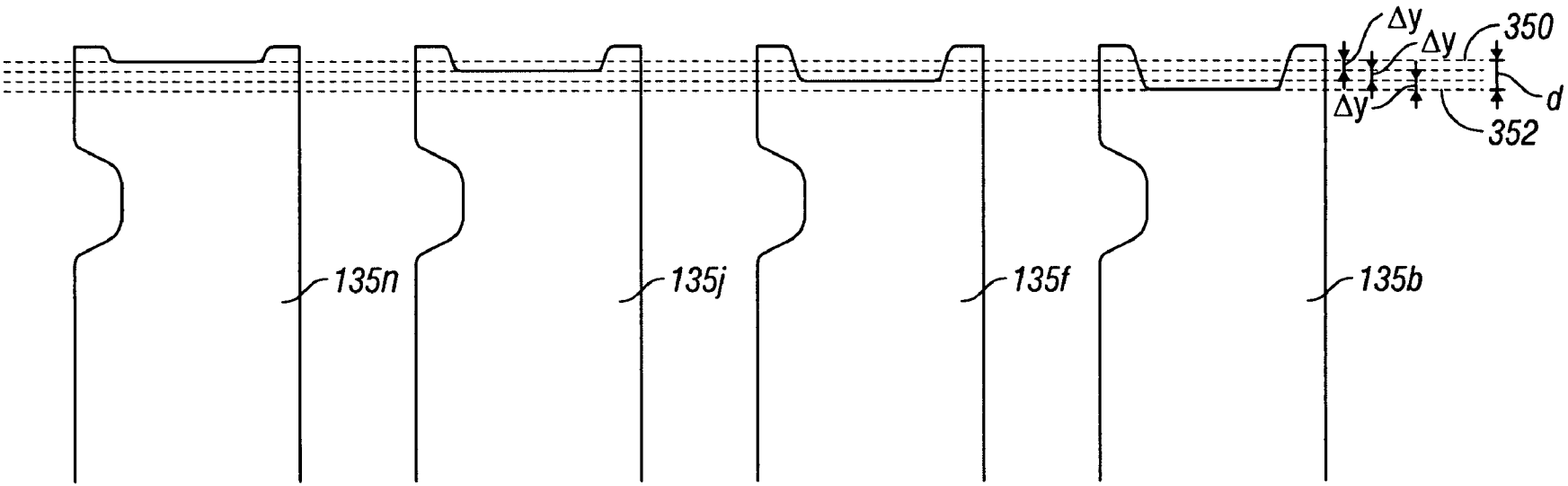
FIG. 3E is a schematic representation of openings in a mounting assembly plate.

FIG. 3E shows a simplified schematic representation of an embodiment where the y-alignment datums 145 of the adjacent openings 135*b*, 135*f*, 135*j* and 135*n* are precisely machined such the y-alignment datums 145 are not in the same plane, but rather, are offset from an adjacent opening by a predetermined amount Δy. For illustrative purposes, a schematic representation just the openings 135*b*, 135*f*, 135*j* and 135*n* is shown in FIG. 3E. In one embodiment, the offset distance Δy can be the pitch of the ink nozzle openings in each printhead module, p, divided by the number of nozzles per row, n, i.e., Δy=p/n. For example, a y-alignment datum 145 of opening 135*b* is in a plane 350 and a y-alignment datum 145 of opening 135*n* is in a plane 352. Because the y-alignment datum 145 of each opening is in a plane Δy from a plane of an adjacent opening, the planes 350 and 352 are d=3 x Δy apart from one another.

Figure 2B:
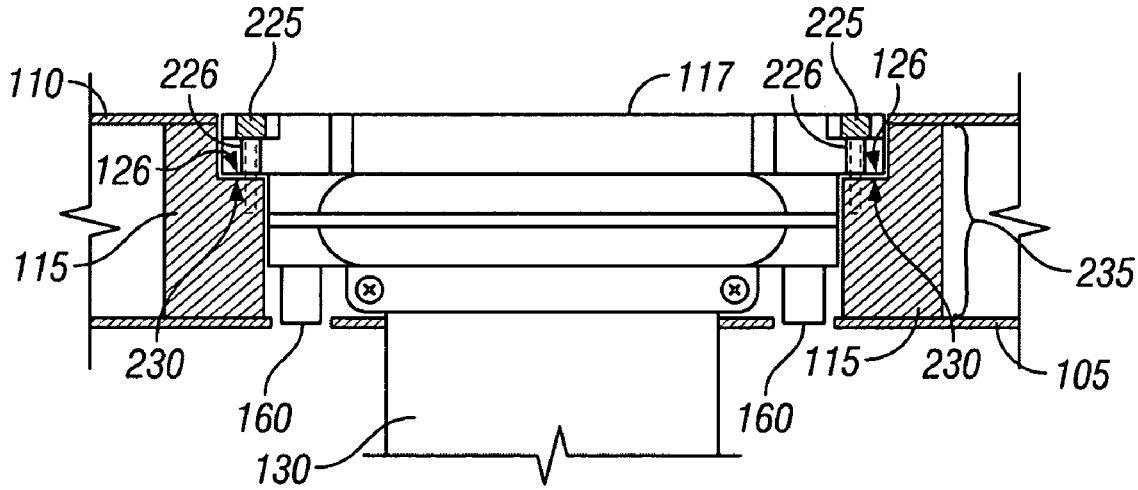
FIG. 2B shows a cross-sectional area of a portion of the mounting assembly of FIG. 1C.

A printhead module can be aligned in the z direction as follows. FIG. 2B shows a cross-section of a portion of the mounting assembly 100 and the printhead module 125*b* shown in FIG. 1C taken along line A-A. The printhead module 125*b* is positioned between mounting blocks 115 at either end of the module 125*b*. The mounting blocks 115 are affixed to the upper and lower plates 105, 110. The printhead module 125*b* is affixed to the mounting blocks 115, for example, using mounting screws 225. Contact surfaces 126 of the printhead module 125*b* contact receiving surfaces 230 of the mounting blocks 115. The mounting screws 225 are dropped into through-holes 226 in the lower surface of the printhead module 125*b*. The through-holes 226 extend through the module. The mounting screws 225 exit the contact surfaces 126 of the printhead module 125*b* and are received by corresponding apertures formed in receiving surfaces 230 of the mounting blocks 115. The receiving surfaces are z-alignment datums 230 and can be used to control the position of the printhead module 125*b*, and therefore the ink nozzles, in the z direction.

By positioning the z-alignment datums 230 of all of the mounting blocks 115 included in the mounting assembly 100 at precisely the same distance from the upper and lower plates 105, 110 (i.e., in the same plane), the ink nozzles of printhead modules mounted on the z-alignment datums can be positioned in substantially the same plane in the z direction. The ink nozzles are therefore a uniform distance from a printing media upon which ink drops are ejected from the ink nozzles, thereby providing substantially uniformly shaped and sized ink drops. Each mounting block 115 is created with substantially the same height 235 to maintain the parallel upper and lower plates 105, 110 a substantially uniform distance from one another.

A printhead module, such as printhead module 125*a*, can be positioned in and secured to the mounting assembly 100 as follows. The printhead module 125*a* is positioned within the opening 135*a* so that the x-alignment tabs 305 are pressed against the x-alignment datums 140 and the y-alignment tab 310 is pressed against the y-alignment datum 145. An installation tool, such as a spring or flexure, can be used to bias the printhead module 125*a* into position during installation. The printhead module 125*a* can then be clamped to the mounting assembly 100 by inserting the mounting screws 225 into the through-holes 226 and screwing them into the mounting blocks 115. The through-holes 226 can be configured to provide some movement of the printhead module 125*a* in the x and y directions relative to the mounting screws 225. However, once the mounting screws 225 are screwed into the mounting blocks 115, the clamping force of the mounting screws 225 on the lower surface of the printhead module 125*a* holds the printhead module 125*a* securely in position. Once secured, the installation tool can be removed. The printhead module 125*a* is thereby aligned in the x and y directions, because the x-alignment tabs 305 are aligned to the x-alignment datums 140 and the y-alignment tab 310 is aligned to the y-alignment datum 145. The printhead module 125*a* is also aligned in the z direction, because the contact surfaces 126 of the printhead module 125*a* are aligned with the z-alignment datums formed by the receiving surfaces 230.

Referring again to FIGS. 1A and 1B, the mounting assembly 100 can further include corner supports 120 that are also created with substantially the same height as the mounting blocks 115, so as to maintain the upper and lower plates 105, 110 a substantially uniform distance from one another. The corner supports 120 provide additional rigidity to the mounting assembly 100 and can be affixed to the upper and lower plates 105, 110 in any suitable manner, including screws, adhesive or both.

The upper plate 105 can include multiple flexible circuit openings 165 and ink channel openings 160. A flexible circuit 130 extending from each printhead module 125 can pass through a corresponding opening 165 in the upper plate to a processor located in a printer. The ink channel openings 160 align with corresponding ink channels in the printhead modules, such that ink can be transported into and/or out of each printhead module. The ink channel openings 160 and flexible circuit openings 165 are shaped and positioned according to the configuration of printhead modules housed within the mounting assembly 100.

In one embodiment, a printhead module can be configured as described in U.S. patent application Ser. No. 10/836,456, entitled "Elongated Filter Assembly" of Kevin von Essen, filed Apr. 30, 2004, the entire contents of which are hereby incorporated by reference. The printhead modules 125 housed in the embodiment of the mounting assembly 100 shown in FIGS. 1A and 1B can be configured as shown in FIGS. 4A-D. Each printhead module includes a filter assembly 400 and a printhead housing 420. The filter assembly 400 includes an upper portion 405, lower portion 410 and a thin membrane 415 positioned between the upper portion 405 and the lower portion 410. The filter assembly 400 is mounted on a printhead housing 420, that is configured to house a printhead body for ejecting ink drops from an ink nozzle unit, such as the semiconductor printhead body described in U.S. Provisional Application, Ser. No. 60/510,459, entitled "Print Head with Thin Membrane", filed Oct. 10, 2003.

Each of the upper and lower portions 405, 410 include at least one ink channel. In the embodiment shown in FIG. 4A, there are two ink channels 422, 424 in the upper portion 405, and two ink channels 426, 428 in the lower portion 410. An ink channel can function as either an inlet channel or an outlet channel, depending on the direction of ink flow, and whether the ink is recirculating through the printhead module 400. If the ink is recirculating, then one ink channel in upper portion 405 operates as an inlet and the other as an outlet, and similarly, one ink channel in the lower portion 410 operates as an inlet and the other as an outlet.

The ink channels 422, 424 formed in the upper portion 405 of each printhead module 125 housed within the mounting assembly 100 are substantially aligned with corresponding ink channel openings 160 formed in the upper plate 105 of the mounting assembly 100. The openings 160 formed in the upper plate 105 permit the ink channels 422, 424 of the printhead module 125 to couple to one or more ink sources.

Figure 4A:
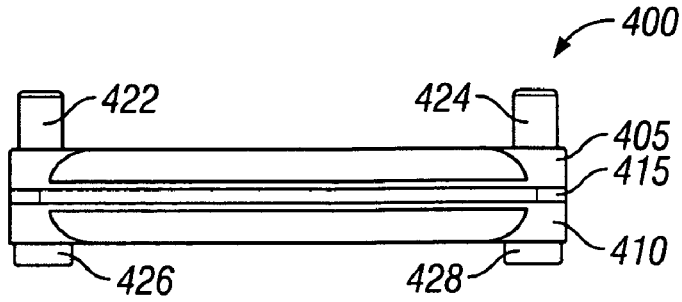
FIG. 4A shows a filter assembly of a printhead module.
Figure 4B:
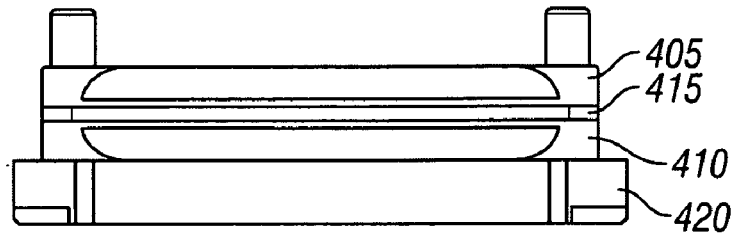
FIG. 4B shows the filter assembly of FIG. 4A mounted on a printhead housing.
Figure 4C:
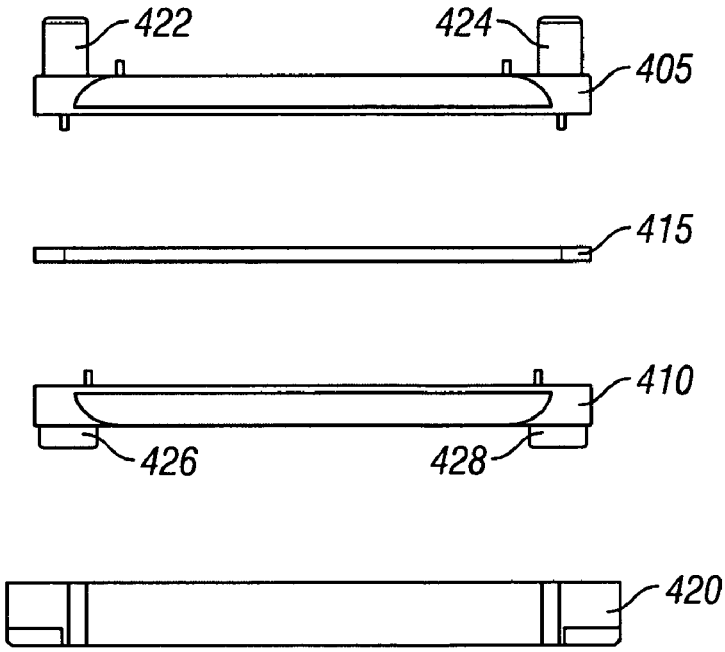
FIG. 4C is an exploded view of the filter assembly and printhead housing of FIG. 4B.
Figure 4D:
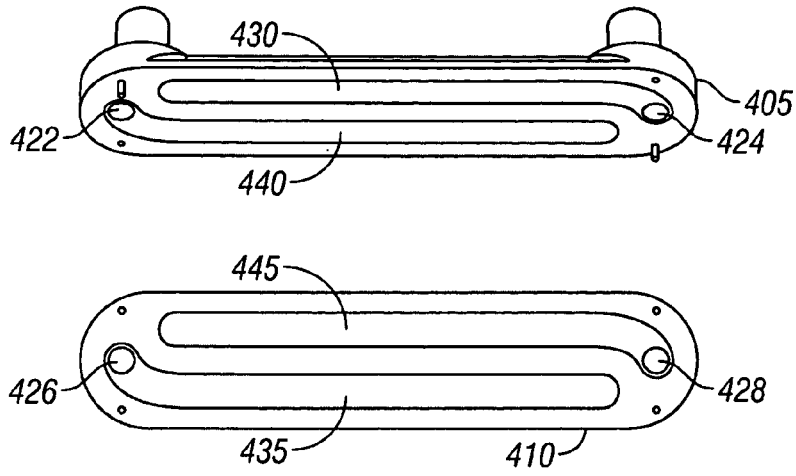
FIG. 4D is an exploded view of the filter assembly of FIG. 4A.

FIG. 4D shows a plan view of the lower portion 410 and a tilted side view of the upper portion 405, to illustrate the relationship of the upper and lower portions 405, 410. When the upper and lower portions 405, 410 are assembled as shown in FIG. 4A, an interior elongated chamber is formed between the portions 415, 420 for each pair of ink channels (a pair being an ink channel in the upper portion and a corresponding ink channel in the lower portion). That is, in the embodiment shown there are two pairs of ink channels, and accordingly there are two interior elongated chambers formed between the upper and lower portions 405, 410 when assembled.

An upper section of a first elongated chamber 430 is formed in the upper portion 405 of the filter assembly 400, which corresponds with a lower section of the first elongated chamber 435 formed in the lower portion 410 of the filter assembly 400. The first elongated chamber 430-435 forms a first ink path for ink flowing between the ink channel 424 formed in the upper portion 405 and the corresponding ink channel 426 formed on the opposite end of the lower portion 410.

Similarly, an upper section of a second elongated chamber 440 is formed in the upper portion 405, which corresponds with a lower section of the second elongated chamber 445 formed in the lower portion 410. The second elongated chamber 440-445 forms a second ink path for ink flowing between the ink channel 422 formed in the upper portion 405 and the corresponding ink channel 428 formed on the opposite end of the lower portion 410.

A membrane providing a permeable separator between an upper section and a lower section of an elongated chamber formed within the filter assembly 400 can filter ink as ink flows from one end of the elongated chamber to the other. For example, a membrane 415 can be positioned between the upper and lower portions 405, 410 of the filter assembly 400 as shown in FIG. 4A, thereby separating the upper section 430 of the first elongated chamber from the lower section 435, and separating the upper section 440 of the second elongated chamber from the lower section 445. Alternatively, a separate membrane can be used to separate each of the elongated chambers.

Figure 5A:
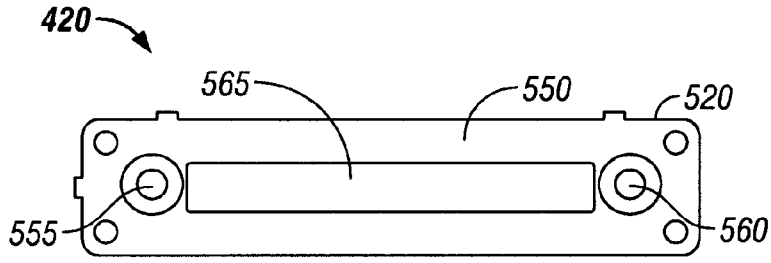
FIG. 5A shows an upper surface of a printhead housing.
Figure 5B:
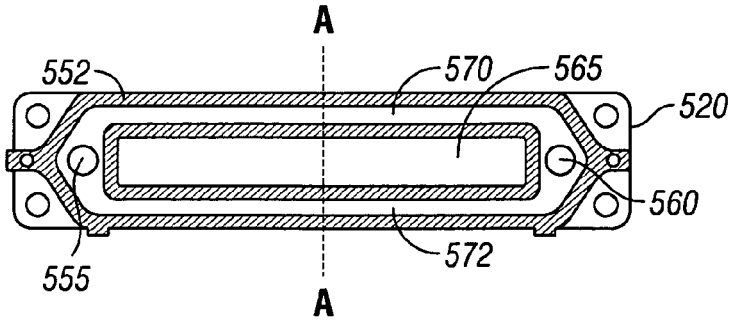
FIG. 5B shows a lower surface of a printhead housing.
Figure 5C:
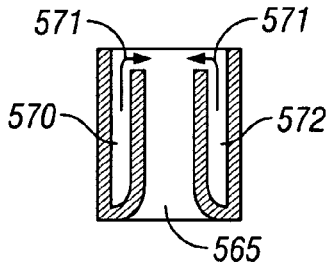
FIG. 5C shows a cross-sectional view of the printhead housing of FIG. 5B.

Referring to FIGS. 5A-C, the printhead housing 420 is shown. FIG. 5A shows a plan view of a surface 550 of the printhead housing 420 that mates with the lower portion 410 of the filter assembly 400. An opening to an ink channel 555 aligns with the ink channel 426 formed in the lower portion 410 of the filter assembly 400, and a second opening to a second ink channel 560 aligns with the ink channel 428 formed in the lower portion 410. FIG. 5B shows a plan view of the opposite surface 552 of the printhead housing 420. An opening 565 is configured to house a printhead assembly, for example, a semiconductor printhead, that includes an ink nozzle unit for injecting ink drops. The ink channels 555 and 560 terminate in channels 570 and 572 formed on either side of the opening 565. A cross-sectional view of the printhead housing 520 taken along line A-A is shown in FIG. 5C, illustrating the channels 570 and 572 formed along the length of the printhead assembly 410. The ink flows along the paths 571 shown from the channels 570, 572 toward and into an ink nozzle assembly within a printhead (not shown) that can be mounted within the opening 565.

In the embodiment of the printhead module shown in FIGS. 4A-D, which includes two pairs of ink channels, there are at least two ink flow patterns; in a first ink flow pattern both ink channels 422, 424 formed in the upper portion 405 operate as ink inlets and both ink channels 426, 428 formed in the lower portion 410 operate as ink outlets. In a second ink flow pattern, one ink channel 424 in the upper portion 405 and one ink channel 428 in the lower portion 410 operate as ink inlets, while the remaining ink channel 422 in the upper portion 405 and ink channel 426 in the lower portion 410 operate as ink outlets. The second ink flow pattern can be a recirculation scheme. In some applications, the ink must be kept moving, so as not to coagulate, and/or must be kept at a temperature significantly above the ambient temperature. In such applications, a recirculation scheme may be appropriate.

Referring to FIG. 6, the mounting assembly 100 is shown with a recirculation assembly 600 mounted on the upper plate 105 of the mounting assembly 100. In one embodiment, a recirculation assembly can be configured as described in U.S. Provisional Application Ser. No. 60/567,035, entitled "Recirculation Assembly" of Kevin von Essen, filed Apr. 30, 2004, the entire contents of which are hereby incorporated by reference.

The recirculation assembly 600 includes an upper layer 605 and a lower layer 610. Ink can enter the recirculation assembly 600 through a main ink inlet 630 and exit through a main ink outlet 635. Ink flows from the main ink inlet 630 through the recirculation assembly 600, where some of the ink is passed to the multiple of printhead modules 125; the remainder of the ink moves through the recirculation assembly 600 and exits through the main ink outlet 635. The ink that is passed to the multiple printhead modules 125 may either be consumed during a printing operation, or may recirculate through the printhead modules 125 and pass back to the recirculation assembly 600 and exit through the main ink outlet 635.

The ink flow originates at an ink source. In some applications, the ink source is heated to maintain the ink at a certain temperature above the ambient temperature, for example, to maintain a desired viscosity of the ink. Once the ink flows through the recirculation assembly 600 and printhead modules 125, the ink can be returned to the same ink source, such that the temperature can be maintained. Alternatively, the ink can be returned to a different location, which may or more may not be in fluid communication with the ink source.

Figure 7A:
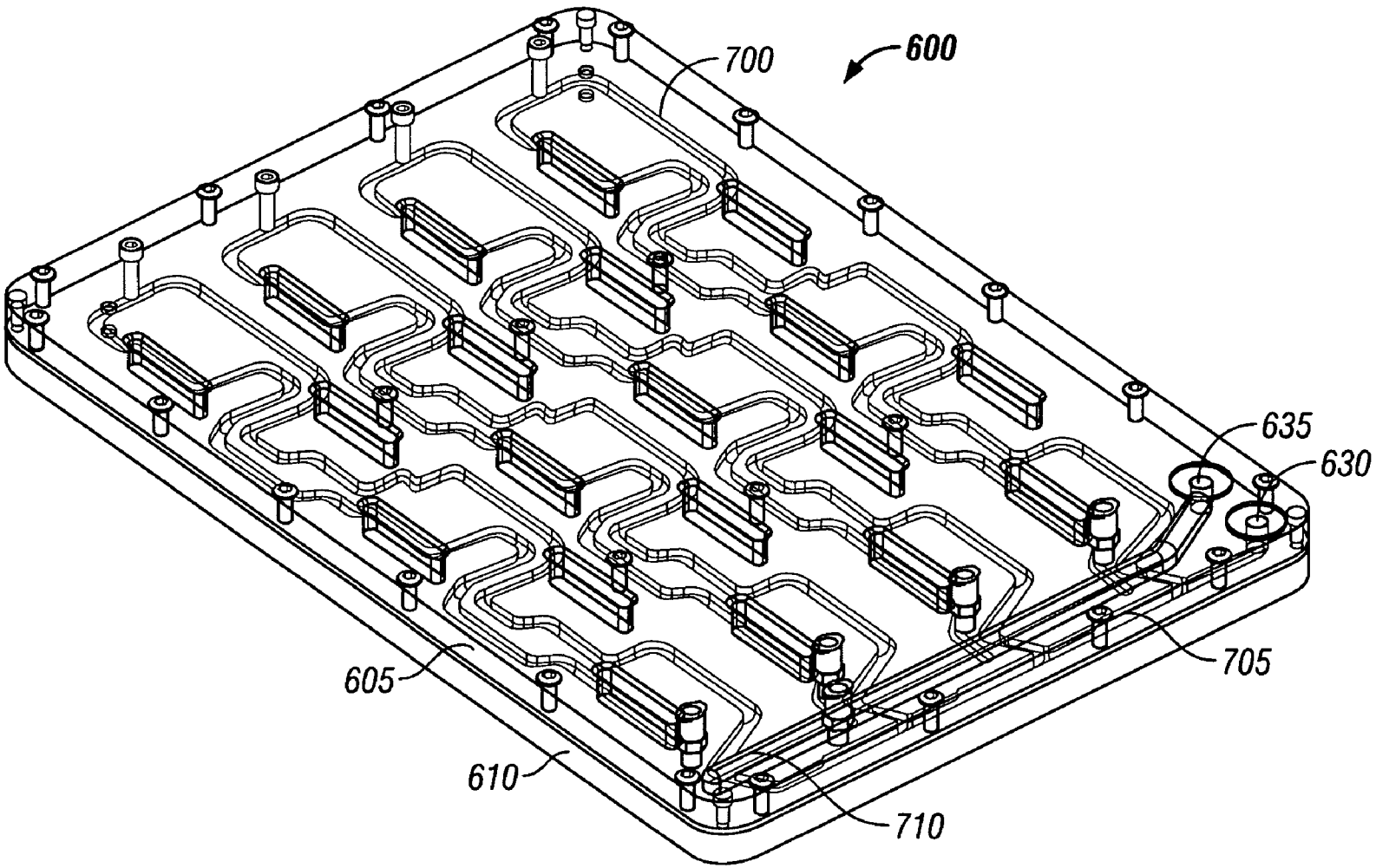
Figure 7B:
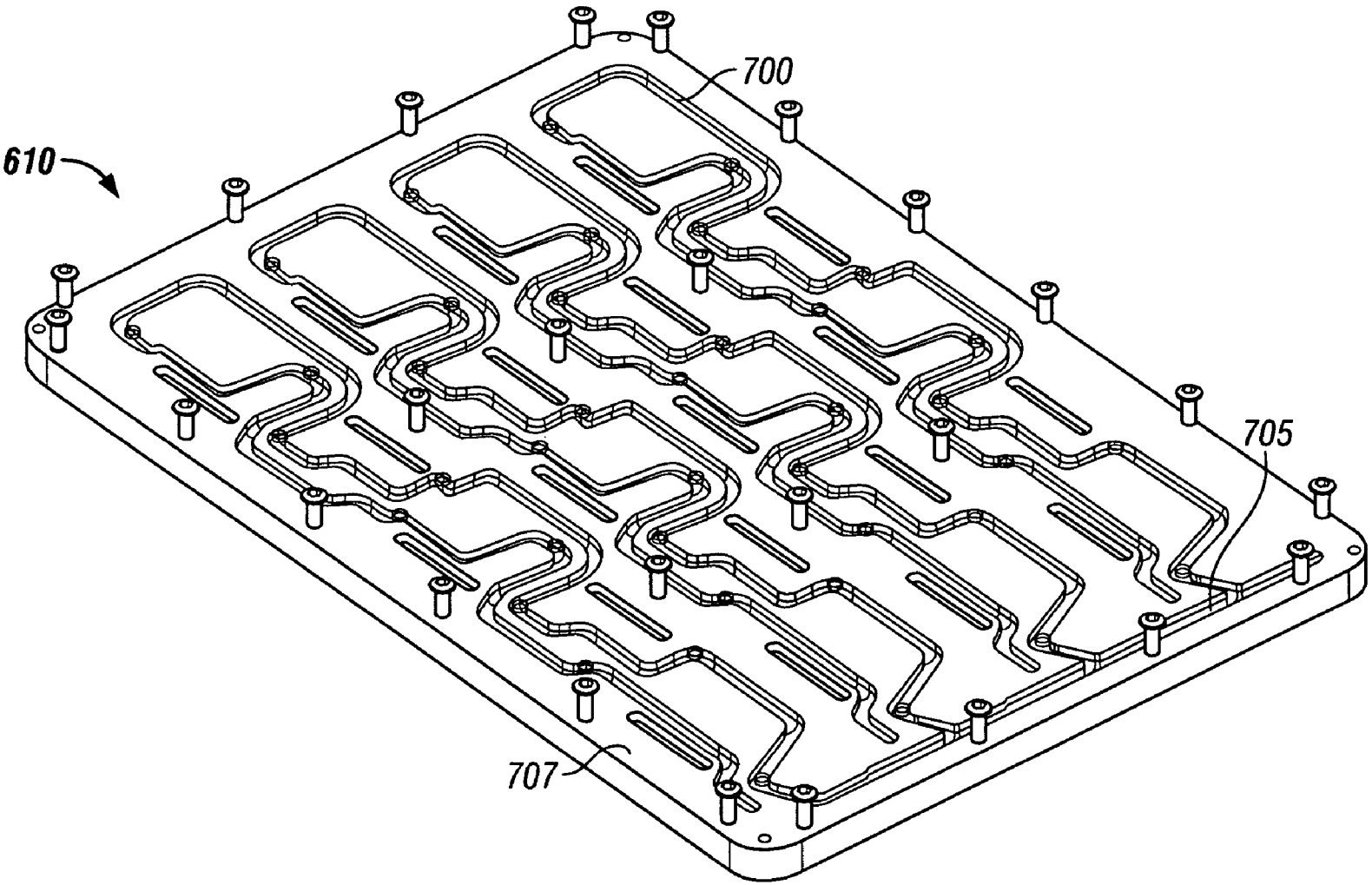
Figure 7C:
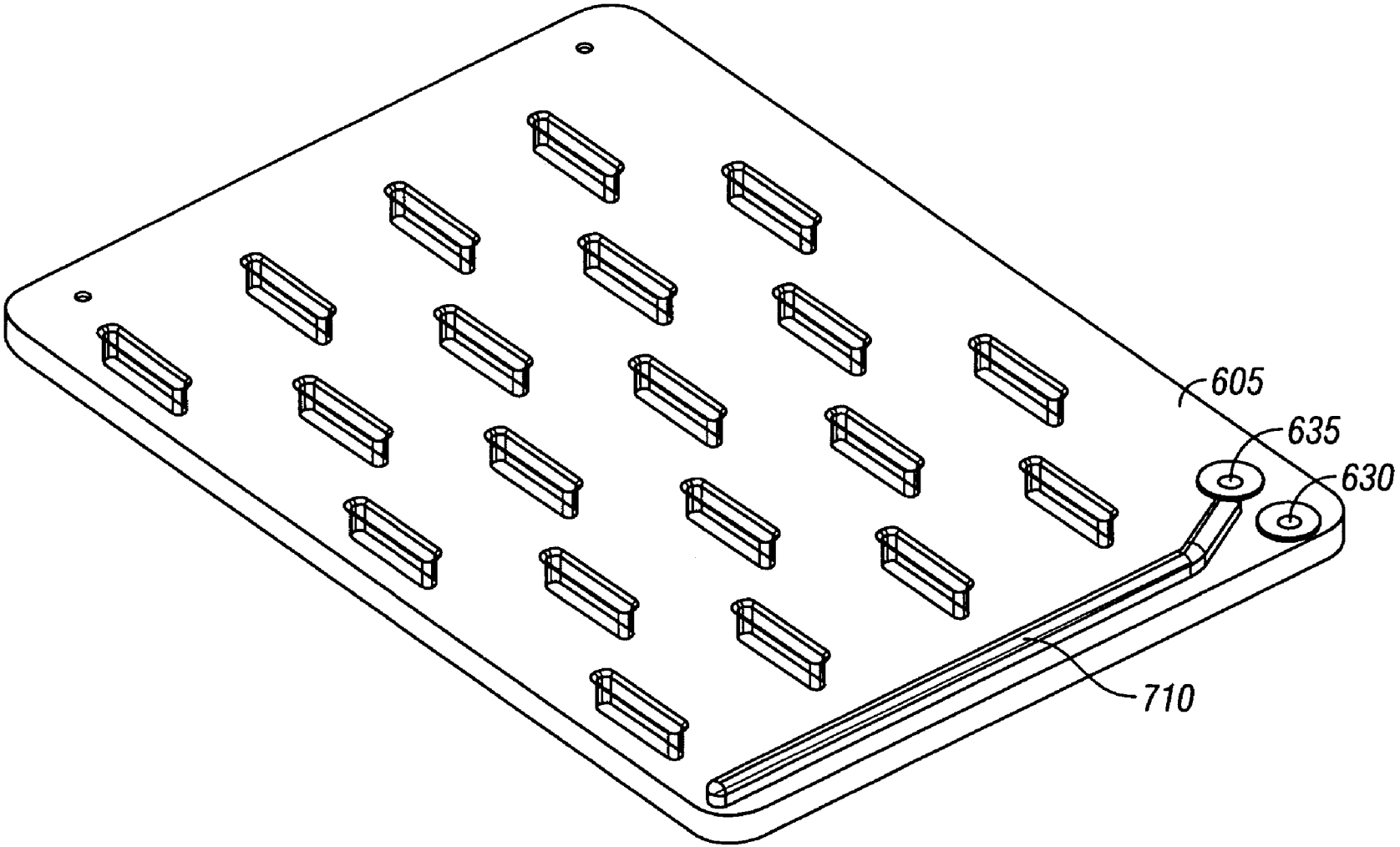

FIG. 7A shows the upper layer 605 of the recirculation assembly 600 affixed to the lower layer 610; the upper layer 605 is drawn as transparent, such that a channel 700 formed in the lower layer 610 is visible. An inlet channel 705 extending from the main ink inlet 630 along one side of the lower layer 610 carries ink from the main ink inlet 630 to four sets of inlet/outlet portions of the channel—each set of inlet/outlet portions corresponding to a set of four printhead modules housed in the mounting assembly 100. The inlet channel 705 is shown in FIG. 7B, which depicts the inner surface 707 of the lower layer 610. FIG. 7C shows the upper layer 605, which includes an outlet channel 720 that connects to each outlet portion of the channel and terminates at the main ink outlet 635.

Figure 7D:
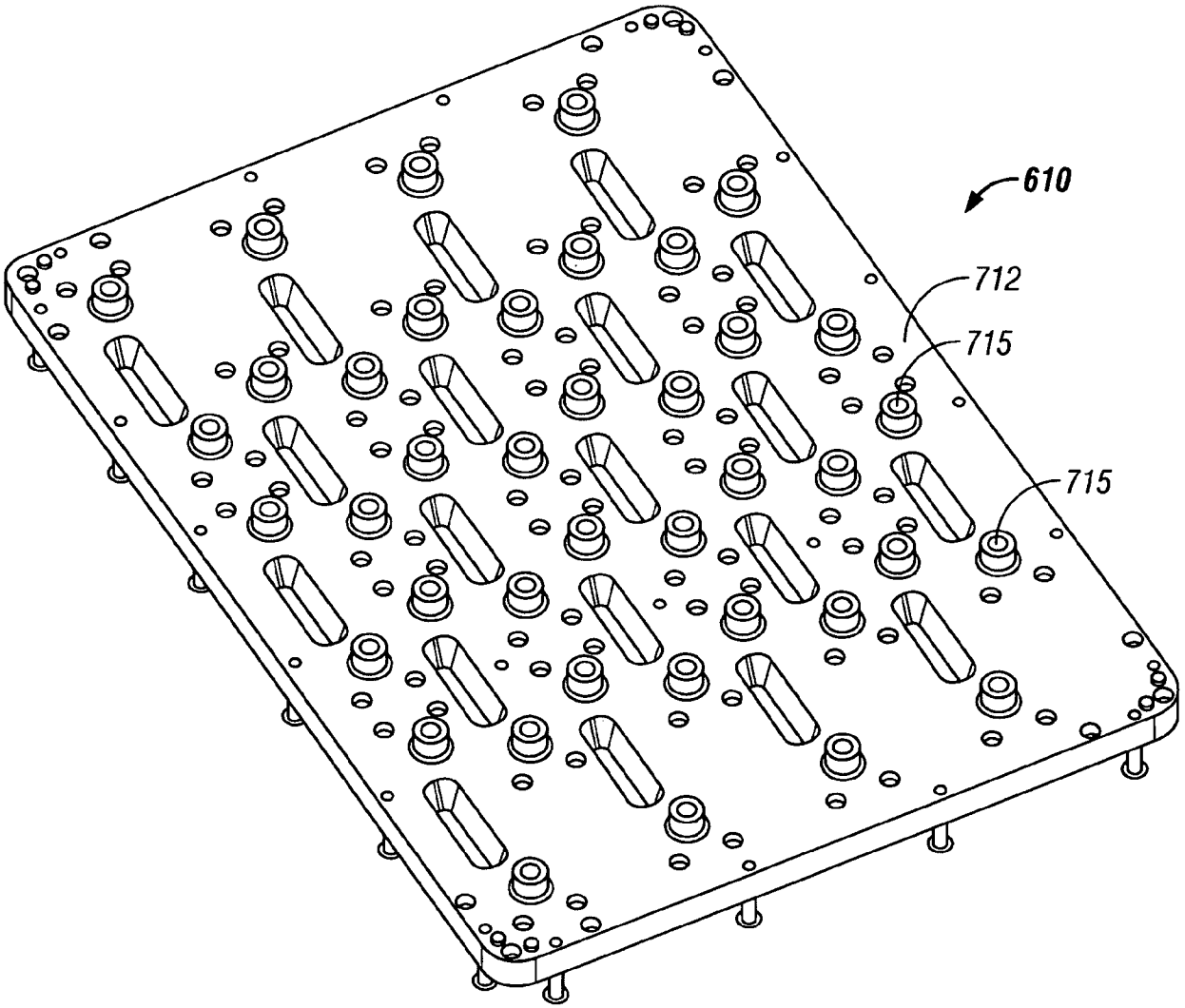

FIG. 7D shows the outer surface 712 of the lower layer 610, which outer surface 712 mates with the upper plate 105 of the mounting assembly 100. Openings formed in the channel 700 in the lower layer 610 lead to ink channels 715 formed on the outer surface 712 of the lower layer 610. The ink channels 715 are configured to engage corresponding ink channel openings 160 formed in the upper plate 105 of the mounting assembly 100 and mate with ink channels formed in the printhead modules 125 housed by the mounting assembly 100. In this manner, ink flow through the channel 700 is in fluid communication with the printhead modules 125 housed by the mounting assembly 100.

The upper and lower layers 605, 610 of the recirculation assembly 600 can be formed from any convenient material. In one embodiment, a crystal polymer, such as Ticona A130 LCP (Liquid Crystal Polymer) is used and the channels are formed in the upper and lower layers 605, 610 by injection molding, although other techniques, e.g., machining, vacuum or pressure forming, casting and the like can be used to form the channels. The upper and lower layers 605, 610 are connected to each other with a liquid tight connection, to ensure ink passing between the layers does not escape. For example, a B-stage epoxy can be used to join the layers together and to provide a seal, preventing leakage of ink. Alternatively, or in addition to an adhesive, such as the B-stage epoxy, multiple screws can be used to join the upper and lower layers 605, 610. Other techniques to the join the layers can include ultrasonic or solvent welding, elastomeric seals or gaskets, dispensed adhesive, or a metal-to-metal fusion bond.

The lower layer 610 can be affixed to the upper plate 105 of the mounting assembly 100 using any convenient means, such as screws, an adhesive or both. Referring to FIG. 8, a compressible 805 seal can be positioned between each ink channel 715 formed on the outer surface 712 of the lower layer 610 and the corresponding ink channels 422, 424 formed on the printhead module 125, such that ink cannot escape while moving between the recirculation assembly 700 and the printhead module 125. The compressible seal 805 can be, for example, an O-ring. The printhead module 125 is mounted to the mounting blocks 115 and is not directly secured to the upper plate 105 of the mounting assembly. Because the seal 805 is compressible, the upper and lower plates 105, 110 can therefore move relative to one another in the z direction and the seal can be maintained between the ink channels 422, 424 in the printhead module 125 and the ink channels 715 in the recirculation assembly 600.

Preferably the mounting assembly is formed from materials with a coefficient of thermal expansion as close to zero as possible. Even slight amounts of thermal expansion can change the positioning of the printhead modules enough to misalign ink drops ejected from the printhead modules. In one embodiment, the upper and lower plates 105, 110 can be formed from Invar, for example Invar 36 available from Carpenter Technology Corporation of Wyomissing, Pa. Invar has a coefficient of thermal expansion (CTE) of nearly zero. For example, the CTE of Invar 36 for up to 200° F. is approximately $7.2\times10^{-6}$ of an inch per inch per degree Fahrenheit. The mounting blocks can be formed either from Invar, or from a different material, such as stainless steel or a liquid crystal polymer.

Because a compressible seal is used between ink channels of the recirculation assembly 600 and the corresponding ink channels of the printhead modules 125, the upper and lower plates 105, 110 can move relative to each other without jeopardizing the seal, some amount of thermal expansion in the z direction can be tolerated.

The mounting assembly 100 can be assembled such that the upper and lower plates 105, 110 are substantially parallel to one another according to the process 961 shown in FIG. 9. The mounting blocks 115 and corner supports 120 can be affixed to one of the plates, for example, the lower plate 110 (step 962). The lower plate 110 with the mounting blocks 115 affixed thereto is firmly clamped to a optically flat surface, such as an optically flat piece of granite (step 964). Granite is commercially available with very accurate flatness specifications and provides a stiff structure for deforming the lower plate 110 into a flat condition. The upper plate is affixed to the mounting blocks 115 and corner supports 120 using screws, adhesive or both (step 966); the flat condition of the lower plate 110 therefore results in a flat condition of the mounting assembly 100 as a whole. The mounting assembly 100 is detached from the optically flat piece of granite (step 968), and turned over to provide access to the outer surface of the lower plate 110. The printhead modules 125 are inserted into corresponding openings 135 formed in the lower plate 110, and the flexible circuits 130 are fed through the corresponding openings 165 in the upper plate 105 (step 970). Each printhead module 125 is aligned to the x-alignment 140, y-alignment 145 and z-alignment datums 230 formed in a corresponding opening 165 (step 972) and affixed to mounting blocks 115 at either end of the printhead module 125 (step 974).

Referring to FIGS. 10A and 10B, an alternative embodiment of a mounting assembly 900 is shown. The mounting assembly 900 includes an upper plate 905 and a lower plate 910, the upper and lower plates 905, 910 substantially parallel to one another. The lower plate 910 includes multiple openings 935 configured to house corresponding printhead modules 925. In the embodiment shown, the mounting assembly 900 is configured to house four printhead modules positioned side by side, for example, to print cyan, magenta, yellow and black ink respectively. Each opening 935 includes an inner surface having two x-alignment datums 940 along a lengthwise inner surface, and one y-alignment datum 945 along a widthwise inner surface. More or fewer alignment datums can be used. A printhead module 925 including corresponding x-alignment tabs and a y-alignment tab can be positioned within the opening 935 in alignment with the x-alignment and y-alignment datums 940, 945, respectively.

Referring to FIG. 10B, the upper plate 905 includes openings 960 corresponding to the openings 935 included in the lower plate 910. A portion of each printhead module 925 can extend through an opening 960 in the upper plate 905, or alternatively, the upper plate can be formed in similar manner as the upper plate 105 shown in FIG. 1A, that is, including separate openings for ink channels and a flexible circuit for each printhead module.

A mounting structure 920 is included in the mounting assembly 900 between the upper and lower plates 905, 910. The mounting structure 920 can be formed as a solid support between the upper and lower plates 905, 910 with openings corresponding to the openings formed in the upper plate and the lower plate, thereby providing a housing for each printhead module 925. The mounting structure 920 has a uniform height, thereby maintaining the upper and lower plates 905, 910 a uniform distance from one another and substantially parallel.

The mounting structure 920 includes a mounting block 915 formed within each end of an opening for a printhead module 925. A mounting block 915 provides a mounting surface forming a z-alignment datum 930 for each end of the printhead module. A mounting block 915 can be integral to the mounting structure 920, or attached to the mounting structure, for example, by screws, an adhesive or both. The position of each printhead module 925 can be controlled by aligning the printhead module 925 with the x-alignment datums 940, the y-alignment datum 940 and affixing the printhead module 925 to the z-alignment datums 930 of each mounting block 915, in a similar manner as described above in reference to mounting assembly 100.

Referring to FIG. 10C, in another embodiment, the printhead module 925 can be mounted directly to the upper plate 905. The assembly shown in FIG. 10C has the lower plate 910 removed for illustrative purposes. The printhead module 925 is attached by screws 926 to the upper plate 905. The screws 926 pass through the printhead module 925 via through-holes included therein, and are then screwed into apertures 927 in the upper plate 905 to clamp the printhead module 925 to the mounting assembly 900. In this embodiment, a structure similar to the mounting structure 920 shown in FIG. 10A can be used to space the upper and lower plates 905, 910, but would not include the mounting blocks 915.

The use of terminology such as "upper" and "lower" throughout the specification and claims is for illustrative purposes only, to distinguish between various components of the mounting assembly, recirculation assembly and elongated filter assembly. The use of "upper" and "lower" does not imply a particular orientation of said assemblies. For example, the upper plate of the mounting assembly can be orientated above, below or beside the lower plate, and visa versa, depending on whether the mounting assembly is positioned horizontally face-up, horizontally face-down or vertically.

Although only a few embodiments have been described in detail above, other modifications are possible. Other embodiments may be within the scope of the following claims.

What is claimed is:

1. A mounting assembly for mounting and housing a plurality of printhead modules, comprising:

a lower plate including a plurality of openings, where each opening is configured to expose a surface of a printhead module housed within the mounting assembly and each opening includes at least one alignment datum to align the printhead module in a first direction and at least one alignment datum to align the printhead module in a second direction, the surface of the printhead module including a plurality of ink nozzle openings;

an upper plate approximately parallel to the lower plate, the upper plate including a plurality of openings configured to provide access to ink channels formed in printhead modules housed within the mounting assembly; and a plurality of mounting blocks positioned between and affixed to the lower and upper plates, each mounting block configured to couple to a printhead module and mount the printhead module between the lower and upper plates and each mounting block including a datum to align the printhead module in a third direction;

wherein the plurality of mounting blocks are further configured to maintain the lower and upper plates a substantially uniform distance from one another.

2. The mounting assembly of claim 1, wherein the lower and upper plates are formed from materials with low coefficients of thermal expansion.

3. The mounting assembly of claim 2, wherein the lower and upper plates are formed from Invar.

4. The mounting assembly of claim 1, further comprising a plurality of printhead modules housed within the mounting assembly and affixed to the plurality of mounting blocks, each printhead module including a plurality of ink nozzle openings configured to eject ink drops onto a printing media, the plurality of ink nozzle openings arranged to provide a substantially uniform spacing between ink drops; and wherein, the plurality of printhead modules are aligned in the first, second and third directions such that the substantially uniform spacing between ink drops is maintained between ink drops ejected from outermost ink nozzle openings of adjacent printhead modules.

5. The mounting assembly of claim 1, wherein an alignment datum comprises a protruding region of an inner surface of the opening, the protruding region extending inwardly toward the opening relative to a remainder of the inner surface.

6. The mounting assembly of claim 5, wherein there are two alignment datums in the first direction of each opening and the two alignment datums of an opening are in a same plane.

7. The mounting assembly of claim 6, wherein the alignment datums in the first direction of openings that are adjacent in the second direction are formed such that the alignment datums in the first direction are in a same plane.

8. The mounting assembly of claim 5, wherein the at least one alignment datum in the second direction of each opening is formed such that the alignment datums in the second direction of adjacent openings are in a same plane.

9. The mounting assembly of claim 5, wherein the at least one alignment datum in the second direction of each opening is formed such that the alignment datums in the second direction of adjacent openings are in different planes that are substantially parallel to one another and spaced a predetermined distance from one another.

10. The mounting assembly of claim 5, wherein the alignment datums in the third direction formed on the mounting blocks are formed such that the alignment datums are in a same plane.

11. A method of mounting printhead modules in a mounting assembly, comprising:

positioning a plurality of printhead modules in a plurality of openings formed in a lower plate of a mounting assembly, the mounting assembly including substantially parallel upper and lower plates separated by a plurality of mounting blocks, where the mounting blocks are configured to mount the printhead modules between the upper and lower plates and to maintain the upper and lower plates a substantially uniform distance apart;

aligning each printhead module with at least one alignment datum formed in a first inner surface of the opening to align the printhead module in a first direction;

aligning each printhead module with at least one alignment datum formed in a second inner surface of the opening to align the printhead module in a second direction; and mounting each printhead module onto a receiving surface of at least two mounting blocks, the receiving surface of each mounting block providing an alignment datum in a third direction.

12. The method of claim 11, wherein each of the plurality of printhead modules includes a plurality of ink nozzle openings in a lower surface of the printhead module and the lower surface is exposed by the opening formed in the lower plate of the mounting assembly, where the plurality of ink nozzle openings are configured to eject ink drops onto a printing media and are arranged to provide a substantially uniform spacing between ink drops, the method further comprising:

aligning the plurality of printhead modules relative to one another in the first, second and third directions such that the substantially uniform spacing between ink drops is maintained between ink drops ejected from outermost ink nozzle openings of adjacent printhead modules.

13. The method of claim 11, further comprising:

forming at least one protruding region in the first inner surface of the opening, the protruding region comprising the at least one alignment datum in the first direction; and forming at least one protruding region in the second inner surface of the opening, the protruding region comprising the at least one alignment datum in the second direction.

14. The method of claim 13, wherein there are two alignment datums in the first direction, the method further comprising:

forming the two alignment datums in the first direction of each opening such that the two alignment datums of an opening are in a same plane.

15. The method of claim 14, further comprising:

forming the alignment datums in the first direction of openings that are adjacent in the second direction such that the alignment datums in the first direction are in a same plane.

16. The method of claim 13, further comprising:

forming the at least one alignment datum in the second direction of each opening such that the at least one alignment datums of adjacent openings are in a same plane.

17. The method of claim 13, further comprising:

forming the at least one alignment datum in the second direction of each opening such that the at least one alignment datums of adjacent openings are in different planes that are substantially parallel to one another and spaced a predetermined distance from one another.

18. The method of claim 13, further comprising:

forming all of the alignment datums in the third direction in substantially a same plane.

19. A system for housing printhead modules, the system comprising:

a mounting assembly comprising:

a lower plate including a plurality of openings, where each opening is configured to expose a surface of a printhead module housed within the mounting assembly and each opening includes at least two alignment datums to align the printhead module in a first direction and at least one alignment datum to align the printhead module in a second direction, the surface of the printhead module including a plurality of ink nozzle openings;

an upper plate approximately parallel to the lower plate, the upper plate including a plurality of openings configured to provide access to ink channels formed in printhead modules housed within the mounting assembly; and a plurality of mounting blocks positioned between and affixed to the lower and upper plates, each mounting block configured to couple to a printhead module and including a datum to align the printhead module in a third direction;

a recirculation assembly attached to the upper plate of the mounting assembly, comprising:

a main ink inlet configured to receive ink from an ink source;

a main ink outlet configured to direct ink toward an ink source;

a channel extending between the main ink inlet and the main ink outlet, the channel including an inlet portion and an outlet portion, where:

the inlet portion is configured to move ink from the main ink inlet to a plurality of ink channels in fluid communication with a plurality of ink inlets for each of a plurality of printhead modules; and the outlet portion is configured to move ink away from a plurality of ink channels in fluid communication with a plurality of ink outlets for each of the plurality of printhead modules and toward the main ink outlet; and a plurality of printhead modules housed within the mounting assembly, each printhead module including:

a plurality of ink nozzle openings configured to eject ink drops onto a printing media;

at least one ink inlet in fluid communication with an ink channel formed in the recirculation assembly; and at least one ink outlet in fluid communication with an ink channel formed in the recirculation assembly.

20. The system of claim 19, further comprising:

a compressible seal positioned between each ink inlet channel of a printhead module and a corresponding ink channel of the recirculation assembly and positioned between each ink outlet channel of a printhead module and a corresponding ink channel of the recirculation assembly, such that the upper and lower plates of the mounting assembly can move relative to each other and maintain a seal between the ink inlet and outlet channels of the printhead modules and corresponding ink channels of the recirculation assembly.

* * * * *